US011247092B2

(12) United States Patent
Albert Garcia

(10) Patent No.: US 11,247,092 B2
(45) Date of Patent: Feb. 15, 2022

(54) PORTABLE FULL BODY WORKOUT SYSTEM

(71) Applicant: Kevin Albert Garcia, Petrer (ES)

(72) Inventor: Kevin Albert Garcia, Petrer (ES)

( * ) Notice: Subject to any disclaimer, the term of this patent is extended or adjusted under 35 U.S.C. 154(b) by 120 days.

(21) Appl. No.: 16/795,744

(22) Filed: Feb. 20, 2020

(65) Prior Publication Data

US 2020/0338388 A1 Oct. 29, 2020

Related U.S. Application Data

(60) Provisional application No. 62/809,642, filed on Feb. 24, 2019.

(51) Int. Cl.
*A63B 21/055* (2006.01)
*A63B 21/00* (2006.01)
(Continued)

(52) U.S. Cl.
CPC .... *A63B 21/0557* (2013.01); *A63B 21/00069* (2013.01); *A63B 21/0442* (2013.01); *A63B 21/1645* (2013.01)

(58) Field of Classification Search
CPC ..... A63B 21/0557; A63B 21/00069; A63B 21/0442; A63B 21/1645; A63B 21/00065; A63B 21/00061; A63B 21/1618; A63B 2023/0411; A63B 23/0482; A63B 23/1209; A63B 23/1281; A63B 21/4013; A63B 21/169; A63B 21/154; A63B 21/151;
(Continued)

(56) References Cited

U.S. PATENT DOCUMENTS 5,468,205 A * 11/1995 McFall ..... A63B 21/0552 482/121
5,820,529 A * 10/1998 Weintraub ..... A63B 21/155 482/92
(Continued)

OTHER PUBLICATIONS

FREESIXD—World's First Full-Body Gym That Fits In A Bag https://www.kickstarter.com/projects/pullupanddip/freesixd-worlds-most-versatile-sling-and-resistance-trainer.
(Continued)

*Primary Examiner* — Andrew S Lo
(74) *Attorney, Agent, or Firm* — Walker Griffin Weitzel Alloy Patent Law

(57) ABSTRACT

Presented is a portable full body work out system for indoor and outdoor uses. The system includes a pair of mounts configurable over an intended surface, a pair of bracket assembles releasably mountable over the mounts, a strap with extending around one or more pulleys of one of the bracket assemblies and operatively connecting to a securing device, a resistance band releasably mountable around a retainer member of one of the bracket assemblies and another coupled to the securing device. The securing device is selectively operated during initial set up to allow the user to adopt to an appropriate position to connect an external exercising accessory to the strap for performing an exercise. The user is able to select the desired resistance for the exercise, or reduce the selected resistance, or combine resistances for even greater resistance by selecting appropriate resistance bands, and/or changing the tension applied on the strap.

18 Claims, 17 Drawing Sheets

(51) Int. Cl.
*A63B 21/04* (2006.01)
*A63B 21/16* (2006.01)

(58) Field of Classification Search
CPC ..... A63B 21/0552; A63B 21/4009; A63B 2210/50; A63B 2208/0233; A63B 2225/10; A63B 2208/0238; A63B 2209/10
See application file for complete search history.

(56) References Cited

U.S. PATENT DOCUMENTS 5,910,073 A * 6/1999 Conner ..... A63B 23/0211 482/129
6,267,711 B1 * 7/2001 Hinds ..... A63B 1/00 482/121
6,319,179 B1 * 11/2001 Hinds ..... A63B 21/0552 482/121
6,322,483 B1 * 11/2001 Rotella ..... A63B 21/0552 482/121
6,908,418 B2 * 6/2005 Saure ..... A63B 21/0552 482/121
8,057,370 B2 * 11/2011 Dunn ..... A63B 21/169 482/121
9,242,137 B1 * 1/2016 Hoffman ..... A63B 21/1645
9,339,682 B2 * 5/2016 Braier ..... A63B 21/1618
9,636,535 B2 * 5/2017 Schleiden, II ... A63B 23/03541
10,183,190 B2 * 1/2019 Holland ..... A63B 23/03516
10,926,126 B2 * 2/2021 Ngene ..... A63B 21/4035
2002/0119869 A1 * 8/2002 Whited Lake ..... A63B 21/1663 482/93
2003/0158024 A1 * 8/2003 Saure ..... A63B 21/1645 482/126
2004/0087420 A1 * 5/2004 Montesquieux ... A63B 23/0355 482/129
2005/0221964 A1 * 10/2005 Liester ..... A63B 23/03533 482/114
2010/0173759 A1 * 7/2010 Lalaoua ..... A63B 71/0619 482/121
2011/0177921 A1 * 7/2011 Olson ..... A63B 21/4013 482/92
2012/0077646 A1 * 3/2012 Hetrick ..... A63B 21/018 482/91
2012/0129663 A1 * 5/2012 Dunn ..... A63B 21/169 482/129
2012/0302412 A1 * 11/2012 Nail ..... A63B 21/0552 482/129
2013/0035220 A1 * 2/2013 Adams ..... A63B 21/156 482/129
2013/0324378 A1 * 12/2013 Rountree ..... A63B 23/0355 482/129
2014/0106949 A1 * 4/2014 Mestemaker ..... A63B 21/1636 482/129
2015/0031512 A1 * 1/2015 Schleiden, II ..... A63B 23/1209 482/139
2017/0361150 A1 * 12/2017 Polinsky ..... A63B 21/16
2018/0353813 A9 * 12/2018 Bird ..... G16Z 99/00
2019/0111305 A1 * 4/2019 Robinson ..... A63B 21/0428
2020/0114197 A1 * 4/2020 McGhee ..... A63B 1/00

OTHER PUBLICATIONS

FREESIXD—https://www.youtube.com/watch?v=Fn02hiNr5v0.
FREESIXD—https://www.youtube.com/watch?v=yx2ypwKVZ74.
FREESIXD—https://www.facebook.com/pullupanddip/videos/impressions-of-our-new-product-freesixd/1308840636141122/, Oct. 28, 2020.

* cited by examiner

PORTABLE FULL BODY WORKOUT SYSTEM

CROSS-REFERENCE TO RELATED PATENT DOCUMENTS

This non-provisional patent application is effectively a non-provisional conversion of non-English U.S. provisional patent application No. 62/809,642 filed on Feb. 24, 2019, for which the translation and statement has been filed, the priority benefits of which is hereby claimed.

FIELD OF THE INVENTION

The present disclosure relates to exercise equipments in general, and particularly to a portable full body workout system used for strength training and is suitable for performing a wide variety of resistance exercises both indoor and outdoor.

BACKGROUND

The health benefits of regular body workout or exercise is well known. In this regard, the use of specialized equipments or systems to assist in exercising the body is ever increasing in popularity. Many of existing apparatuses/machines, however, are anatomy-specific in their application and help exercise a particular section of the human muscles, such as biceps, abdomen and so on. For example, U.S. Pat. No. 10,441,846 discloses a bicep exercise machine adjustable in nature that can accommodate different anatomical sizes and lengths of different user forearms and upper arms. Likewise, US20040023763 discloses an arm exercising device usable to exercise just the users arm and shoulders.

Additionally, conventional exercise equipments/devices have been generally focused on to facilitate exercising either upper or lower human body. It is seen that such equipments generally do not have capability to help exercise or work on complete body muscles. Additionally, such equipments also restrict a user's range of movement while the user is performing the work out. For example, U.S. Pat. No. 8,944,973 discloses a lower body exerciser that's designed to exercise the lower body muscles such as lateral and internal leg muscles, front and back muscles of buns, hips, thighs, calves. U.S. Pat. No. 4,492,376 discloses an improved lower extremity exercise board device capable of supporting elastic bands in numerous orientations to facilitate a user to perform a variety of exercises. U.S. Pat. No. 9,776,036 discloses an upper body exercise or a resistance based training device that uses the weight of the exerciser to generate a counterforce that provides resistance to specific upper body exercises. Further, lots of standalone squat machines are also available in the market that help the users exercise their lower body and increase the lower body strength Such as for example, ELITEFTS™ BELT SQUAT MACHINE, ROGERS™ PIT SHARK and so on. These are mechanical and bulkier devices, some requiring fixation on the ground or floor, one need to keep loading or unloading the weight plates on the shaft in order to adjust the exercising resistances that may be cumbersome.

Further, of the available workout or strength training devices, lots of devices claim to have the ability that helps the user perform a full-body workout too. For example, U.S. Pat. No. 4,923,193 discloses a mechanical exercise apparatus suitable for simultaneously performing upper and lower body exercise. U.S. Pat. No. 8,608,631 discloses a multi-function exercise machine for training abdominals, chest, shoulders, back, arms, legs and related cardiovascular system. US20160166878 discloses full body exercise equipment that includes four elongate rails arranged in a generally side-by-side longitudinal configuration and connected together to allow for selected angular arrangements between the rails. Further, the equipment includes a slidable shuttle member provided on each rail with the two inside rails having toe holds and the two outside rails having hand grips. Further, as disclosed a resilient cord or rope is provided for each shuttle for selectable attachment to either end of the shuttle to provide selected resistance against slidable movement of the shuttle in either direction on a respective rail.

Further, lot of inventors in the past has proposed exercising devices/equipments that help perform a variety of exercises and are portable in nature. For example, U.S. Pat. No. 6,494,817 discloses a personal and portable exercising device that may be readily assembled on a hinged door of a structure, such as at home, office, or hotel, disassembled and transported to selected locations for exercising by the user. U.S. Pat. No. 5,601,518 discloses another portable device that may be mounted on a door to perform resistance training. Further, U.S. Pat. No. 7,976,445, US20110177921, U.S. Pat. No. 9,028,381 discloses some other door mountable portable exercise systems, or equipments or gyms.

Additionally, lot of wall mounted cable machines or stations, portable or non-portable home gyms are known in art such as for example, Vanswe™ Fitness Wall Mount Cable Station, XMark™ Functional Trainer Cable Machine (XM-7626), Valor™ Fitness BD-62 Wall Mount Cable Station, BodyBoss™ 2.0, ARCHON™ Wall Mount Commercial Ball Bearing Cable Station. Although, these available equipments facilitate in performing a great variety of exercises such as bicep curls, triceps extensions, shoulder presses, reverse flyes, squats, lunges, ab crunches, chest presses, rows, single arm rows, pull throughs, face pulls, and many more. These types of exercising systems/equipments are mostly suitable for indoor uses such as for home or for small commercial gyms only.

As discussed above, although several efforts have been made in the past for providing exercise devices or systems to either facilitate the user to perform more focused exercises related to a particular section of the human muscles or just exercise the upper or lower body, or to even perform whole body exercise. It can be noted that due to at least the complicated configurations, due to being bulky, increased cost for storage and transportation, unsuitability for uses in a limited indoor space such as bedroom, living room or an office, unsuitability for uses at outdoors, inventor of the present invention believes there is further scope of improvement, and thus, herein proposes a full-body workout device that's portable and can be used for strength training and/or performing a variety of resistance exercises both indoor and outdoor.

BRIEF SUMMARY

It is an objective of the present invention to provide an exercise device or system that can be used to perform a wide range of resistance exercises, such as squats, bicep curls, triceps extensions, shoulder related exercises, hip abductions, back related exercises, and many more.

It is another objective of the present invention to provide a training device that allows a user to exercise the entire body with the same intensity, efficiency and safety as any professional gym machines.

It is another objective of the present invention to provide a training device that allows resistance to be exercised both in favor and against gravity.

It is another objective of the present invention to provide a training device may be applicable or be used for different application areas where resistance exercise may be beneficial such as but not limited to muscle building, physical therapy, weight loss programs, performance enhancement in sports, and so on.

It is another objective of the present invention to provide a training device that allows an exerciser to achieve the same resistance or higher than professional gym machines.

Another objective of the present invention is to provide a portable exercise system or device that can be used indoor and be mounted on a wall surface or on a door of a home, a hotel or an office. Further, the portable exercise system can be used outdoor and be mounted on a variety of vertical structures such as posts, columns, trees or the like structures. Practically, this helps users to follow their workout routines regularly in today's busy life, especially when a user is too busy to go to the gym located at a distant place, and have hopes to be working while performing exercises.

It is another objective of the present invention to provide a portable exercise or workout system that can be used by a vast and diverse consumer base no matter if they are at home, traveling, or away from the gym.

Another objective of the present invention is to provide a portable and personal exercising device that may be conveniently stored and transported and then can be readily assembled and removably secured to the door, or the vertical structure or the wall.

Another objective of the present invention is to provide an exercising device or system that's simple and compact, and yet universally acceptable having an ability to exercise target muscle groups with simple resistance adjustment that can easily be altered to a lower value (as low as 1 kg or even lesser) to a higher value (as high as 300 kgs or even more) by selecting one or more suitable resistance bands and/or changing the tension applied onto an extending strap/rope (where the force is applied while performing the exercise). The resistance adjustment is done based on types of exercises/workout user performs.

These and other features, advantages and objectives of the invention will become apparent from the detailed description below, in light of the accompanying drawings.

BRIEF DESCRIPTION OF THE ACCOMPANYING DRAWINGS

DETAILED DESCRIPTION

Figure 1A:
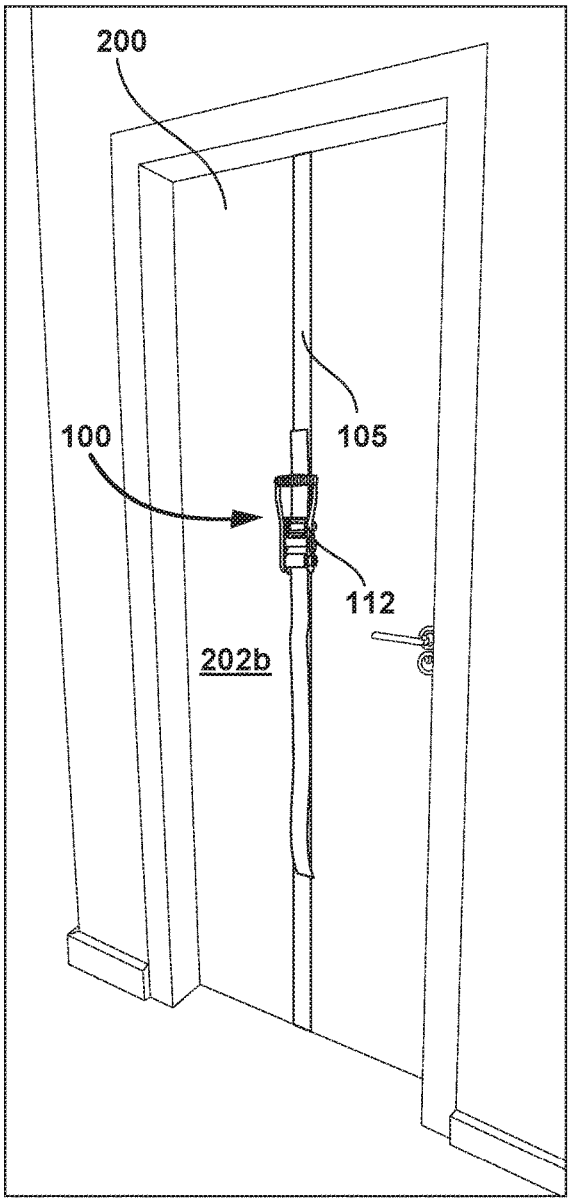
FIGS. 1A-1B shows a back perspective view and a front perspective view of a portable full body workout system of the present invention mounted over a hinged door, according to one embodiment.

As used in the specification and claims, the singular forms "a", "an" and "the" include plural references unless the context clearly dictates otherwise. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items. Those with ordinary skill in the art will appreciate that the elements in the figures are illustrated for simplicity and clarity and are not necessarily drawn to scale. For example, the dimensions of some of the elements in the figures may be exaggerated, relative to other elements, in order to improve the understanding of the present invention. References to "one embodiment", "an embodiment", "another embodiment", "an example", "another example", "some embodiment", and so on, indicate that the embodiments) or example(s) so described may include a particular feature, structure, characteristic, property, element, or limitation, but that not every embodiment or example necessarily includes that particular feature, structure, characteristic, property, element or limitation. Before describing the present invention in detail, it should be observed that the present invention utilizes a combination of components which constitutes a portable full body workout system suitable for use at indoor and outdoor. Accordingly, the components, their interconnectivity and operation have been represented, showing only specific details that are pertinent for an understanding of the present invention so as not to obscure the disclosure with details that will be readily apparent to those with ordinary skill in the art having the benefit of the description herein.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention. Unless stated otherwise, terms such as "first" and "second" are used to arbitrarily distinguish between the elements or entities. Thus, these terms are not necessarily intended to indicate temporal or other prioritization of such elements or priorities.

The proposed portable full body workout system for indoor and/or outdoor uses, and various embodiments associated therewith will now be discussed in detail with respect to the accompanying drawings, particularly FIGS. 1-21.

Referring to FIGS. 1-13, the portable full body workout system 100 and associated components configurable on a door 200 for strength training and performing a variety of resistance exercises are shown. The portable full body workout system 100 includes a plurality of door attachments or adapters such as a first mount A and a second mount A. The door attachments may be identical in shape and dimensions or may differ in shape and dimensions as per the various use case requirements. The first and second mounts A are configured over a first location and a second location of a surface (a front surface 202*a* or a rear surface 202*b*) of a hinged door 200. The first and second mounts A are preferably mounted near a top and bottom surface edges 204*a*, 204*b* of the door 200 as best seen in FIG. 3. The door 200 is representative of number of types or sizes of doors used in houses or offices or other planar members to which the proposed portable full body workout system 100 may be attached.

According to the embodiment, the door attachments such as the first and second mounts A are configured over the first location and second location of the surface 202*a* or 202*b* of the door 200 using a first fastener system. The first and second locations where the first and second mounts A are configured are spaced apart and are vertically in-lined to each other such that one mount is at the top of the door 200 and other mount is at the bottom of the door 200 and are separated by a distance along the door surface. In an example, the first and second locations may be separated at a distance of 1.75 meters. In an example, the first fastener system may include but not limited to a ratchet strap system as seen configured in FIGS. 1A-1B. This starp may be used to tightly fasten the first and second mounts A along the door surface. For example, the strap 105 of the fastener system engages to, or passes through an opening of each of the plate members 102*a* of the mounts A (such as the pair of horizontally oriented elongated openings 102*e* of each of the plate members 102*a* of the mounts A) to fixedly attach the first and second mounts A over the first and second location of the surface 202*a* of the door 200. The strap 105 used for frictionally holding the first and second mounts A against the front surface 202*a* of the door 200 surrounds the entire length of the door 200 and the two ends of the strap 105 are operatively held together by one or more attachment devices such as a tensioner device 112 located at rear surface or side 202*b* of the door 200 as best seen in FIG. 1A. The tensioner device 112 can be selectively operated to tighten the strap 105 to appropriately mount the two mounts A over the door 200. In operation, in order to properly use the strap 105, one end of the strap 105 is threaded through the mandrel of the tensioner device 112 and then the device 112 is cranked to tighten the strap 105 so that the first and second mounts A are fixedly held against the door surface 202*a*. Further, in order to release the strap 105, a release tab of the tensioner device 112 is pressed to open up the tensioner device 112. According to the embodiment, various other forms of devices (one lighter in weight and/or compact in size) may be used to substitute the tensioner device 112 presented in FIG. 1A.

Figure 4A:
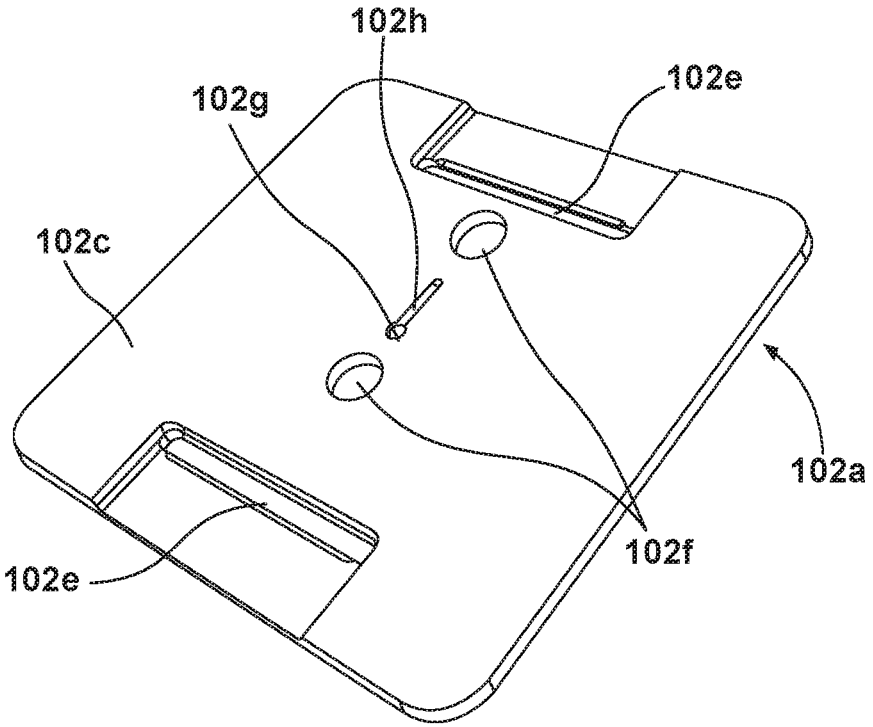
FIGS. 4A-4B shows a top perspective view and a bottom perspective view of a plate member of the mount of FIG. 3, according an embodiment of the present invention.
Figure 4B:
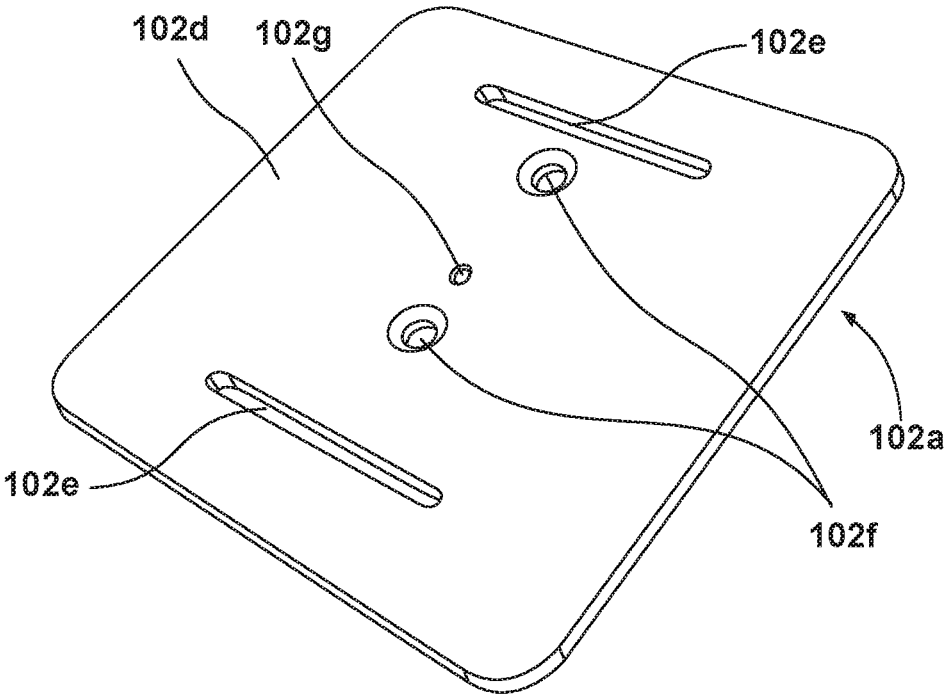
Figure 4C:
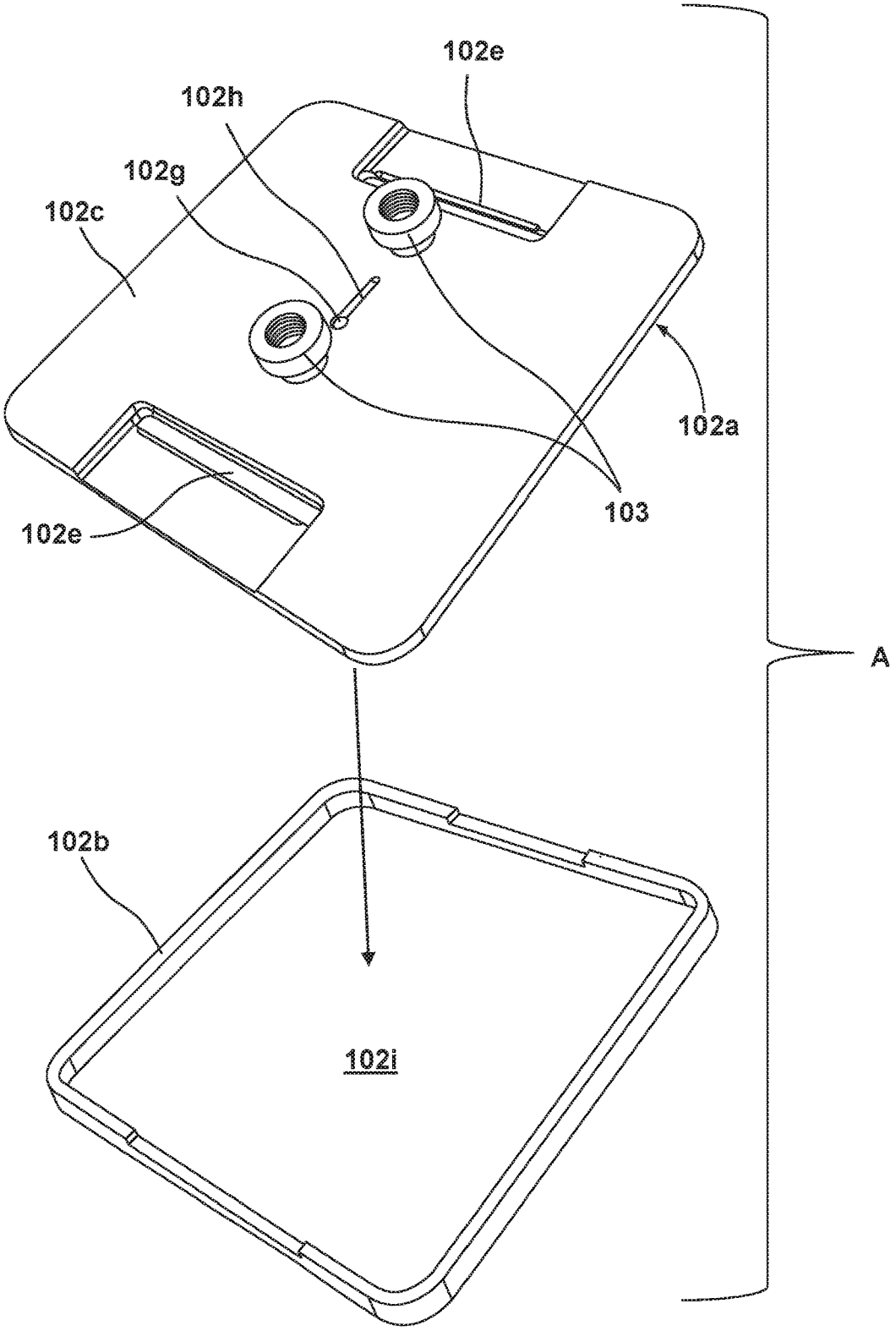
FIG. 4C shows various structural components of the mount of FIG. 3, according one embodiment of the present invention.

The mounts A comprises various structural components or elements attached to each other as best seen in FIG. 4C. As seen in FIGS. 4A-4C, each of the first and the second mount A includes a plate member 102*a* having a top surface 102*c*, a bottom surface 102*d*, a pair of horizontally oriented elongated openings 102*e* each located in proximity to a top and bottom surface edges of the plate member 102*a*, a pair of slots 102*f* located in between the two horizontally oriented elongated openings 102*e*. The plate member 102*a* further includes a bearing slot 102*g* located in between the pair of slots 102*f*, and a recessed channel 102*h* extending away from the bearing slot 102*g* towards one of the slots 102*f*. The recessed channel 102*h* is located over the top surface 102*c* of the plate member 102*a*. As seen in FIG. 4C, the mounts A further includes a pair of engagement members 103 that releasably and rotatably engages to the pair of slots 102*f*. Further, the mounts A may optionally include a cover 102*b*. The cover 102*b* may be made of rubber, plastic, silicon or the like material. The cover 102*b* is dimensioned such that the plate member 102*a* can fit within the cover 102*b* to provide a protective shield between the plate member 102*a* and the door surface 202*a*. This ensures, the movements of the plates 102*a* do not leave any scratches on the door surface 202*a*, while setting up the system 100 on the door 200.

Turning to FIGS. 1, 2 and 5A-5B, the portable full body work out system 100 includes a bracket assembly 104 mountable over the first mount A. The bracket assembly 104 includes a body portion 104*b*. The body portion 104*b* comprises a pair of mountable slots 104*c* and a rollable/bearing lock 104*d* located in between the mountable slots 104*c*. The mountable slots 104*c* are shaped and sized such as to engage to the corresponding engagement members 103 of the mount A. The bracket assembly 104 further includes a retainer member 104*a* integrally coupled to the body portion 104*b*. In an example, the retainer member 104*a* is a U shaped hook. In another example, the retainer member 104*a* may include a carabiner. In order to mount the bracket assembly 104 over the mount A, the bearing lock 104*d* is slidably rolled along the recessed channel 102*h* to engage to the bearing slot 102*g*. Depending upon, if the bracket assembly 104 is mounted over the mount A located near the top edge surface of the door 200 or located near the bottom edge surface of the door 200, the bracket assembly 104 is quickly assembled by a push in a downward direction or an upward direction so that the bearing lock 104*d* gets engaged into the bearing slot 102*g*. Further, in order to un-mount the bracket assembly 104 from the mount A for storage or transportation purpose, the bracket assembly 104 is pushed in a reverse direction. For example, if the assembly 104 is present mounted over the mount A located near the top edge surface of the door 200, then the user can simply push it in upward direction to disengage the bearing lock 104*d* from the bearing slot 102*g*. Similarly, if the assembly 104 is present mounted over the mount A located near the bottom edge surface of the door 200, and then the user can simply push it in the downward direction to disengage the bearing lock 104*d* from the bearing slot 102*g*.

Turning to FIGS. 1, 2 and 6A-6C, the portable full body work out system 100 includes a bracket assembly 106 mountable over the second mount A. The bracket assembly 106 is releasably mountable over the second mount A. The bracket assembly 106 includes a first portion 106*a*. The portion 106*a* includes a pair of mountable slots 106*d* shaped and sized suitably so that the slots 106*d* can engage to the corresponding engagement members 103 of the mount A. The portion 106*a* of the bracket assembly 106 also includes a rollable lock or a bearing lock 106*e* located in between the mountable slots 106*d*. The bracket assembly 106 further includes a second portion 1066 that houses one or more rotatable pulleys 106*c*. The one or more pulleys 106*c* may be welded, soldered, bolted, riveted, integrally formed with, or otherwise connected to the portion 106*b*. The second portion 106*b* of the bracket assembly 106 is swingably coupled to the first portion 106*a*. In order to mount the bracket assembly 106 over the mount A, the bearing lock 106*e* is slidably rolled along the recessed channel 102*h* and to engage to the bearing slot 102*g*. Depending upon, if the bracket assembly 106 is mounted over the mount A located near the top edge surface of the door 200 or located near the bottom edge surface of the door 200, the bracket assembly 106 may be pushed in a downward or an upward direction to engage the bearing lock 106*e* into the bearing slot 102*g*. Further, in order to unmount the bracket assembly 106 from the mount A, the bracket assembly 106 is pushed in a reverse direction similar to the bracket assembly 104.

Figure 1B:
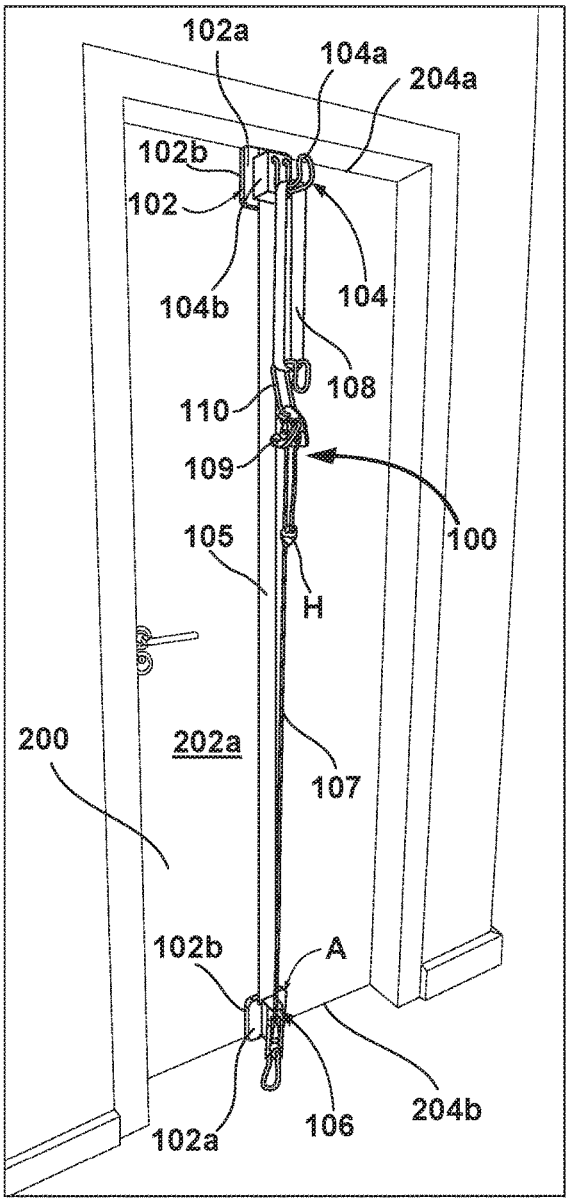
Figure 2:
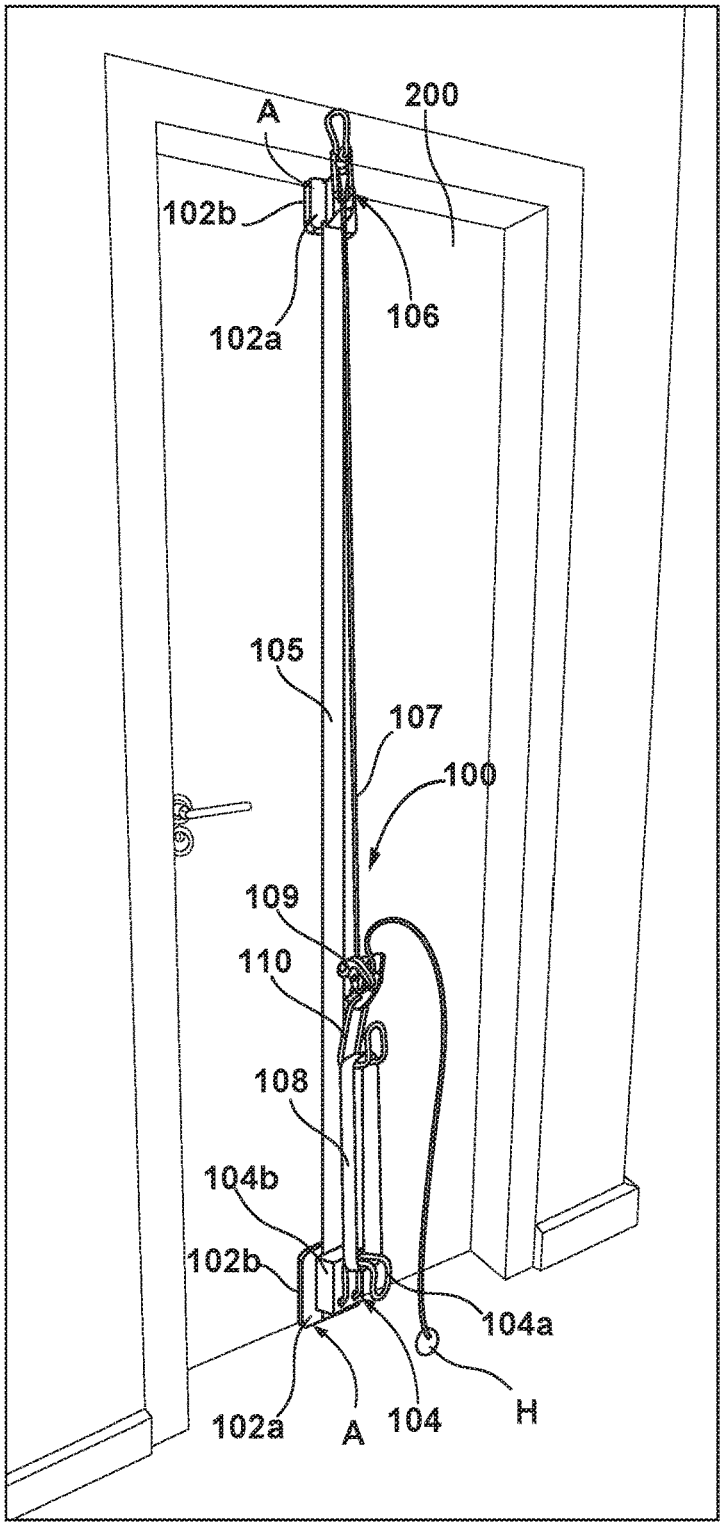
FIG. 2 shows a front perspective view of the workout system of FIG. 1 mounted onto the hinged door in a different configuration, according to one embodiment.
Figure 3:
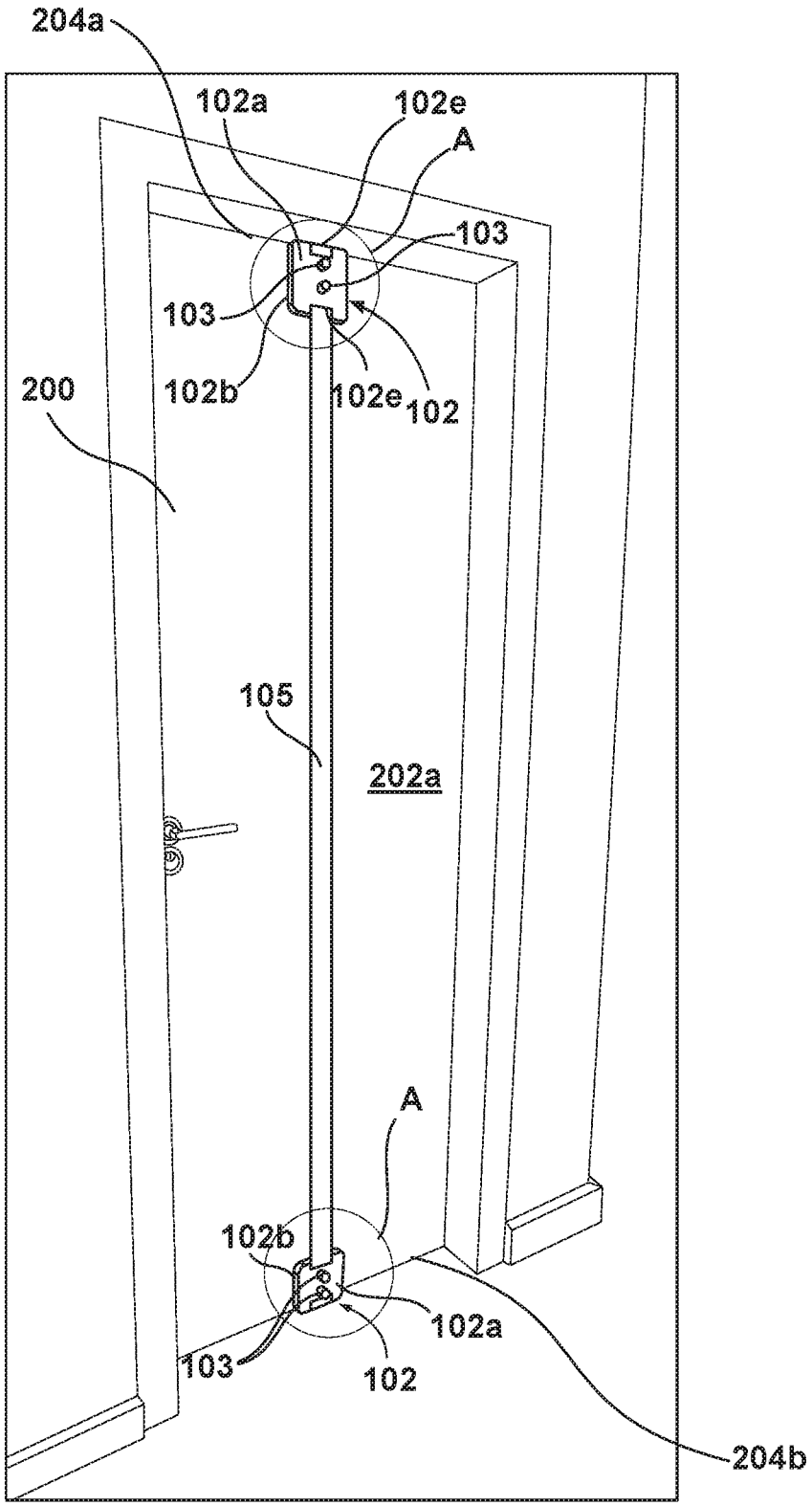
FIG. 3 shows a mount (represented as 'A') according to one embodiment of the present invention, that can be suitably configured over a front surface of the hinged door in proximity to a top edge surface, and a bottom edge surface of the door.
Figure 5A:
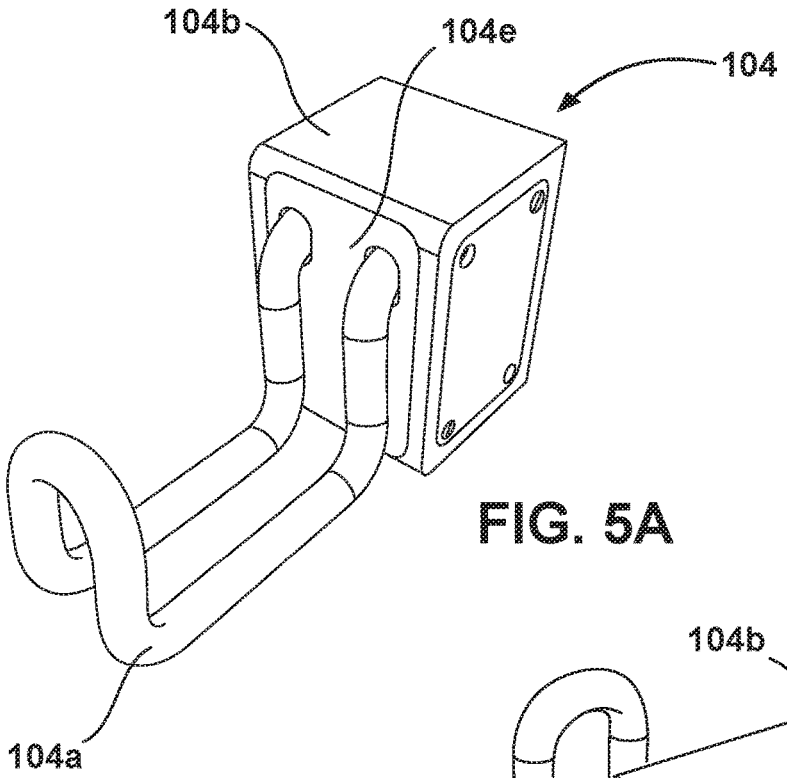
FIGS. 5A-5B shows a front perspective view and a back perspective view of a first bracket assembly, that can be releasably mounted over the mount of FIG. 3, according to one embodiment of the present invention.
Figure 5B:
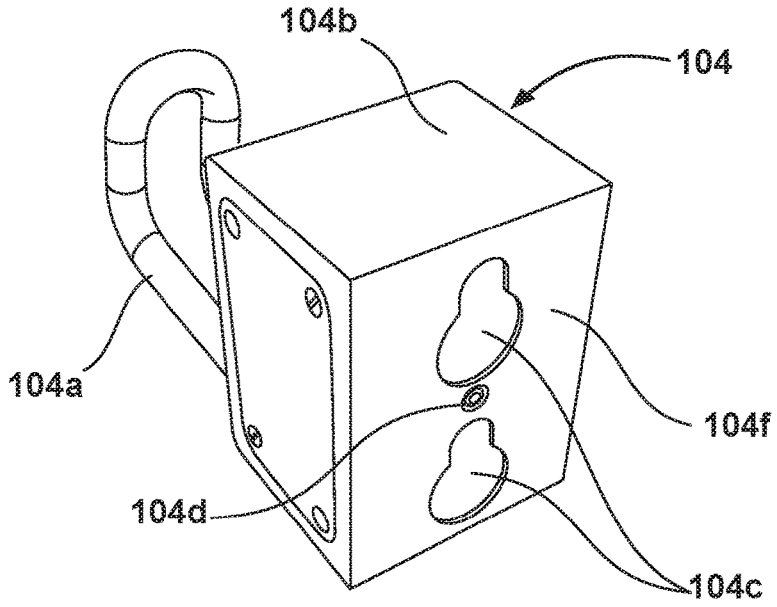
Figure 5C:
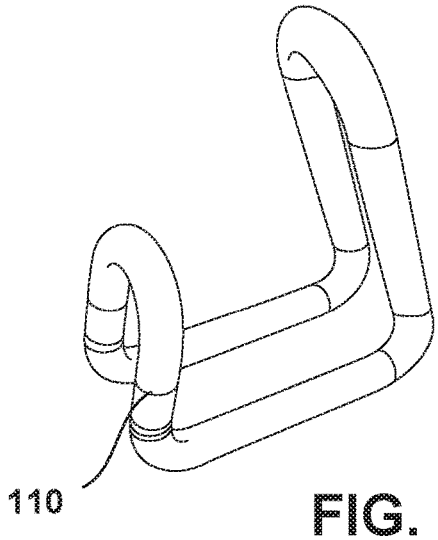
FIG. 5C shows a retainer member coupled to a securing device, according to an embodiment.
Figure 6A:
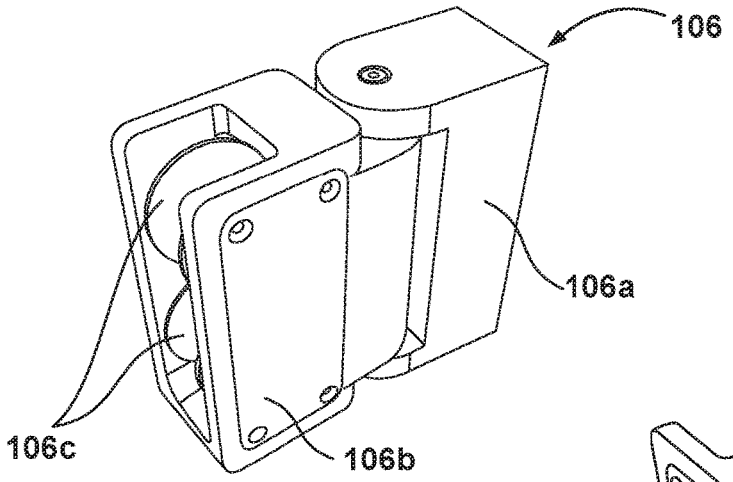
FIGS. 6A-6C shows a front perspective view, a back perspective view, and a front view of a second bracket assembly, according to one embodiment of the present invention.
Figure 6B:
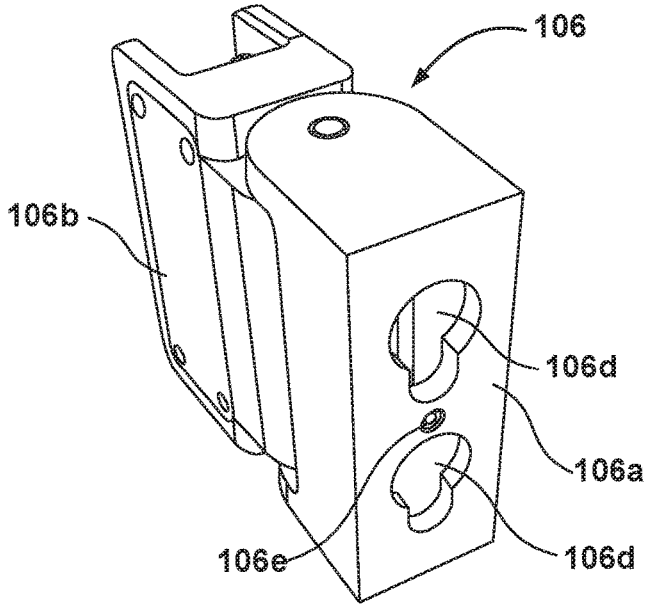
Figure 6C:
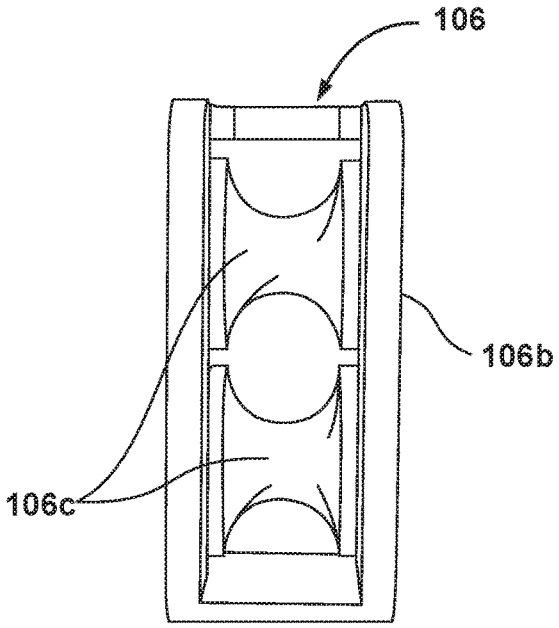
Figure 7:
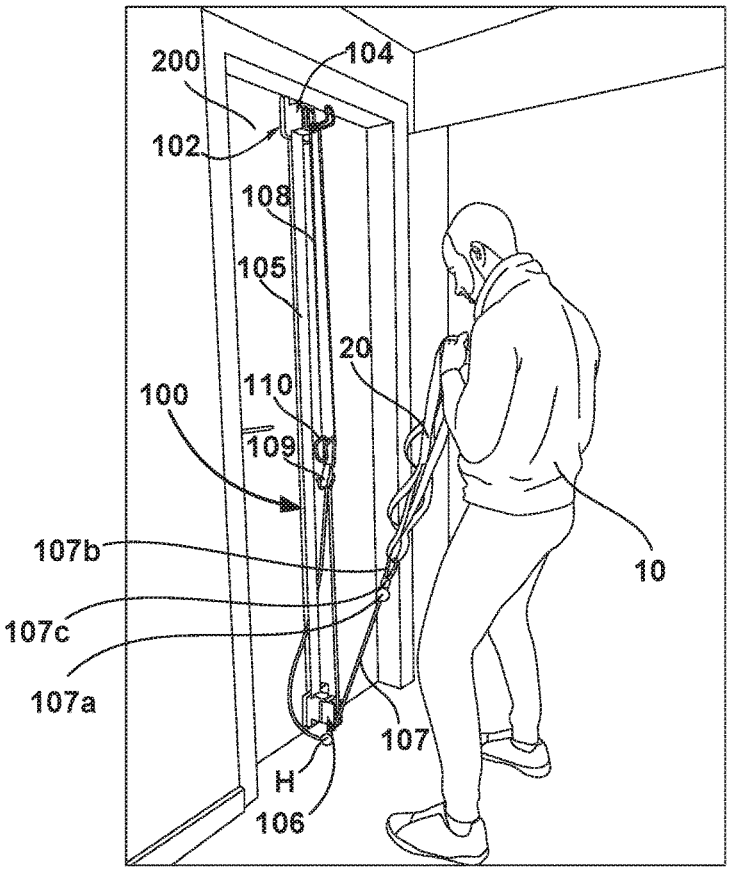
FIGS. 7-13 shows perspective views of the work out system of FIG. 1 and/or FIG. 2 in use by a user for performing variety of resistance exercises.

As seen in FIGS. 1, 2 and 7, the portable full body work out system 100 further includes a longitudinally extending strap/rope 107 having a first end and a second end. The strap 107 preferably includes but not limited to a rope, or a cable. The strap 107 includes a fastener 107*b* attached at its first end. The strap 107 further comprises a stopper 107*a* and a loop 107*c* formed next to the stopper 107*a*. The fastener 107*b* is connected to the loop 107*c*. The second end of the strap 107 extends around the one or more pulleys 106*c* of the second bracket assembly 106 and securely connects to a securing device 109 capable of selectively allowing a user to pull the strap 107 passing therethrough. The securing device 109 includes a retainer member 110 coupled thereto. The retainer member 110 (as seen in FIG. 5C) is preferably a U shaped hook. In some other embodiment, the retainer member 110 may include a carabiner. The securing device 109 according to an embodiment is a belay device that acts as a brake on a movable strap/rope 107 by applying friction to it. The friction caused by the belay device slows down and stops the movement of the rope/strap 107. One of exemplary belay device includes GRIGRI® by Petzl. In operation, inside the GRIGRI®, the rope/strap 107 runs along a cam; the cam allows the rope/strap 107 to pass if moving slowly but rotates or blocks movement of the rope 107 with the amount of "weight" preferably when pressure applied is greater than 1-2 kg approximately. According to the embodiment, the second end of the strap 107 includes a hand grip H for facilitating the user to pull the strap 107 across the securing device 109. The securing device 109 (such as Grigri®) allows to increase or offload/decrease some resistance while performing the exercises (without any need to add or subtract resistance bands 108). In an example, for example, when small resistance change is desired the user can just achieve such changes by just manipulating the securing device 109.

As seen in FIGS. 1-2 and 7-13, the full body work out system 100 further includes at least one resistance band or tension band 108 having a predetermined resistance value. The resistance band 108 is releasably attached around, and extending between the retainer member 104*a* (of the bracket assembly 104) and the retainer member 110 (coupled to the securing device 109). Based on the type of exercise chosen by the user, the tension band 108 may be chosen, one can choose one or multiple resistance bands 108 and hook it around the retainer members 110 and 104*a*. The resistance bands 108 may be made of a resilient material. The amount of force required to stretch the resilient material or band 108 to a particular distance is based on the elastic properties of the material. The resistance provided by the resilient materials may also vary between different types of selected resistance bands 108. For example, if the user chooses two resistant bands 108, it might be possible to use both the bands 108 made of material with same elastic properties and both made of material having different elastic properties. Thus, the user can select the resistance desired for an exercise, or can combine resistances for even greater resistance options.

Further, during initial set up of the system 100 on the door 200, the securing device 109 is selectively operated to allow the strap/rope 107 to be pulled so that the user can adapt to an appropriate position to connect an external exercising accessory (such as an accessory 20) to the fastener 107*b* of the strap 107 for performing an exercise. Once connected, the user can select the resistance desired for the exercise, or can reduce the resistance, or can combine resistances for even greater resistance by selecting one or more appropriate resistance bands 108, or by changing the tension on the strap 107 by operating the securing device 109 or by a combination of these steps thereof.

FIGS. 7-13 shows different exemplary strength training exercises that can be performed using the proposed invention.

Referring to FIG. 7 in particular shows the work out system 100 of the present invention in use by a user 10 for performing bicep curls. This strength training exercise in particular works on biceps muscles at the front of the upper arm, and also the muscles of the lower arm—the brachialis, and brachioradialis. Once the exercising system 100 is set up by the user 10 over the door 200 with an appropriate workable resistance (that can again be adjusted by the user 10 as described above), the user 10 can use a suitable exercising accessory such as an accessory 20 and connect it to the fastener 107*b* of the strap 107, and once the user 10 has adapted to a start position with appropriate workable resistance, the user 10 then can pull the strap/rope 107, this pull triggers rotation of the pulleys 106*c* and the strap 107 is pulled upward towards the user 10 stretching the band 108 (which can extend as much as resistance value of the band 108), if the user 10 wishes to lose or add some small resistance value, the user 10 is enabled to do so by operating the securing device 109 that tightens or loosens the rope 107.

Figure 8:
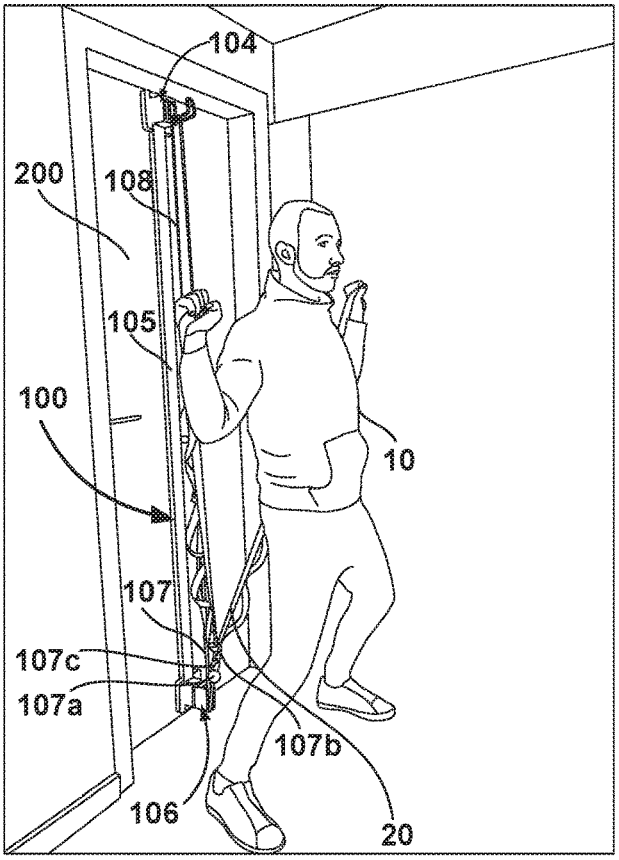

Referring to FIG. 8 in particular shows the work out system 100 of the present invention in use by a user 10 working on his shoulder muscles. This strength training exercise in particular works on shoulder muscles to grow bigger, stronger and wider shoulders. Once the exercising system 100 is set up by the user 10 over the door 200 with appropriate workable resistance (that can again be adjusted by the user 10 as described above), the user 10 can use a suitable exercising accessory such as the accessory 20 and connect it to the fastener 107*b* of the strap 107, and once the user 10 has adapted to a start position with appropriate workable resistance, the user 10 then can pull the strap/rope 107, this will rotate the pulleys 106*c* and the strap 107 is pulled upward towards the user 10 stretching the band 108 (which can extend as much as resistance value of the band 108), if the user 10 wishes to lose or add some small resistance value, the user 10 is able to do so by operating the securing device 109.

Figure 10:
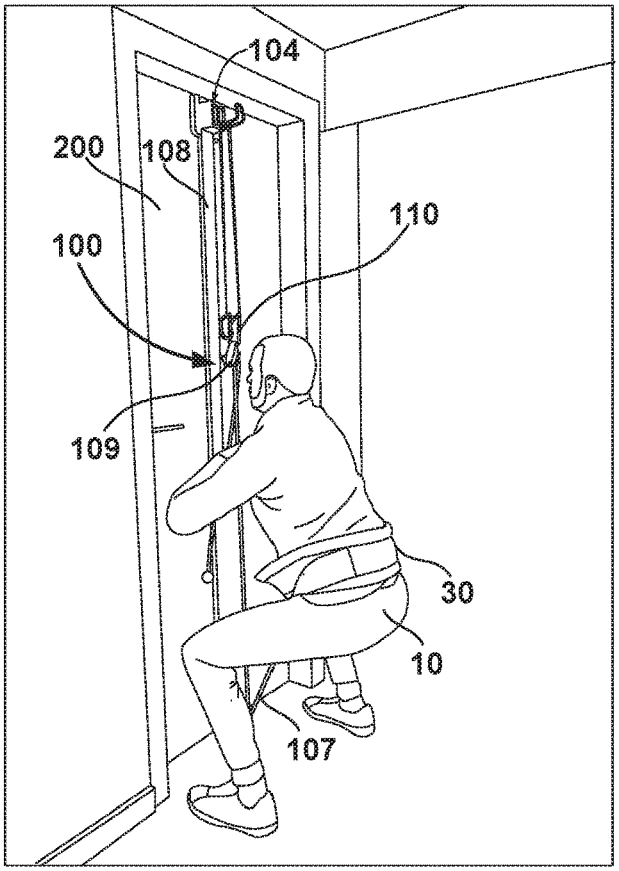

Similar to FIGS. 7-8, FIG. 10 shows the work out system 100 of the present invention in use by a user 10 for performing squats. While performing Squats, the user 10 lowers his hip (as seen in FIG. 10) from a standing position and then stands back up. During the descent of a squat, the hip and knee joints flex while the ankle joint dorsiflexes; conversely the hip and knee joints extend and the ankle joint plantarflexes when standing up. Proper squats strengthen the legs, glutes, and many other muscles, improve lower body mobility, and keep bones and joints healthy. With respect to FIG. 10, once the exercising system 100 is set up by the user 10 over the door 200 with appropriate workable resistance (that can again be adjusted by the user 10 as described above), the user 10 can use a suitable exercising accessory such as the accessory 30 (for example a hip belt) and connect it to the fastener 107*b* of the strap 107, and once the user 10 has adapted to a start position with appropriate workable resistance, the user 10 then can start and pull the strap/rope 107, this will rotate the pulleys 106*c* and the first end of the strap 107 is pulled towards the user 10 stretching the band 108 (which can extend as much as resistance value of the band 108), if the user 10 wishes to lose or add some small resistance value, the user 10 is enabled to do so by operating the securing device 109. Squats can be considered as a dynamic strength training exercise that requires several muscles in the upper and lower body to work together simultaneously.

Figure 9:
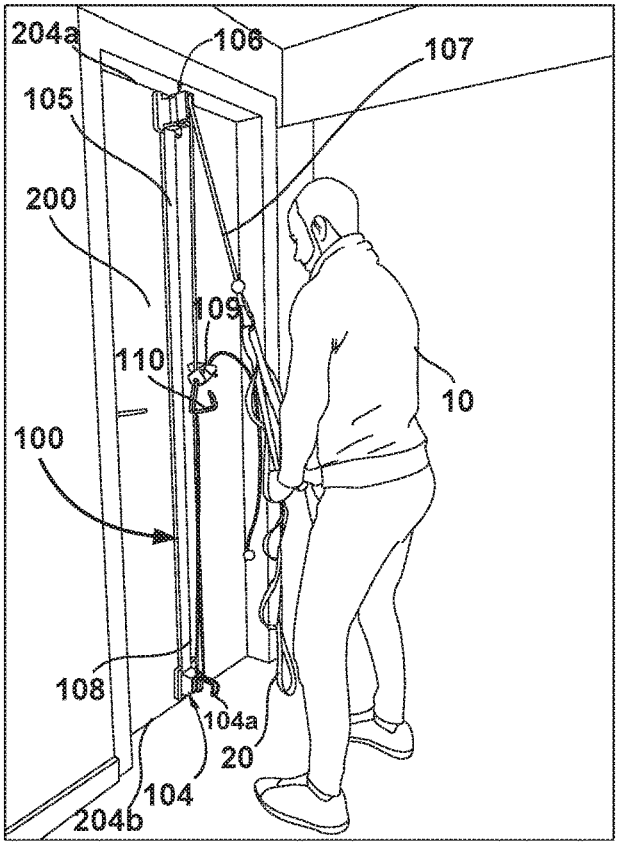

Referring to FIG. 9 in particular shows the work out system 100 of the present invention in use by a user 10 for performing triceps workout. This strength training exercise in particular tones and tightens the muscles at the back of the upper arm. For this particular exercise, the system 100 is setup as shown in FIG. 2. Unlike the system setup of FIG. 1A-1B, while performing triceps workout, the user 10 is required to swap or interchange the positions of the bracket assembly 104 and the bracket assembly 106. The interchange of the positions of the bracket assembly 104 and the bracket assembly 106 enables a user to perform resistance exercises in favor or against the gravity. As seen, in this system setup, the bracket assembly 106 having pulleys 106*c* and the rope 107 is mounted over the mount A located near the top surface edge 204*a* of the door 200, and the bracket assembly 104 with the retainer member 104*a* is positioned (over the mount A) near the bottom edge surface 204*b* of the door 200. Once the exercising system 100 is setup by the user 10 over the door 200 with appropriate workable resistance (that can again be adjusted by the user 10 as described above), the user 10 can use a suitable exercising accessory such as the accessory 20 and connect it to the fastener 107*b* of the strap 107, and once the user 10 has adapted to a start position with appropriate workable resistance, the user 10 then can pull the strap/rope 107, that would rotate the pulleys 106*c* and the strap 107 is pulled downward towards the user 10 stretching the band 108 or exerting tension on the band 108 (which can extend as much as resistance value of the band 108), if the user 10 wishes to lose or add some small resistance value, the user 10 is enabled to do so by operating the securing device 109 that tightens or loosens the rope 107. This exercise can be regarded as part of an upper body strength workout.

Figure 11:
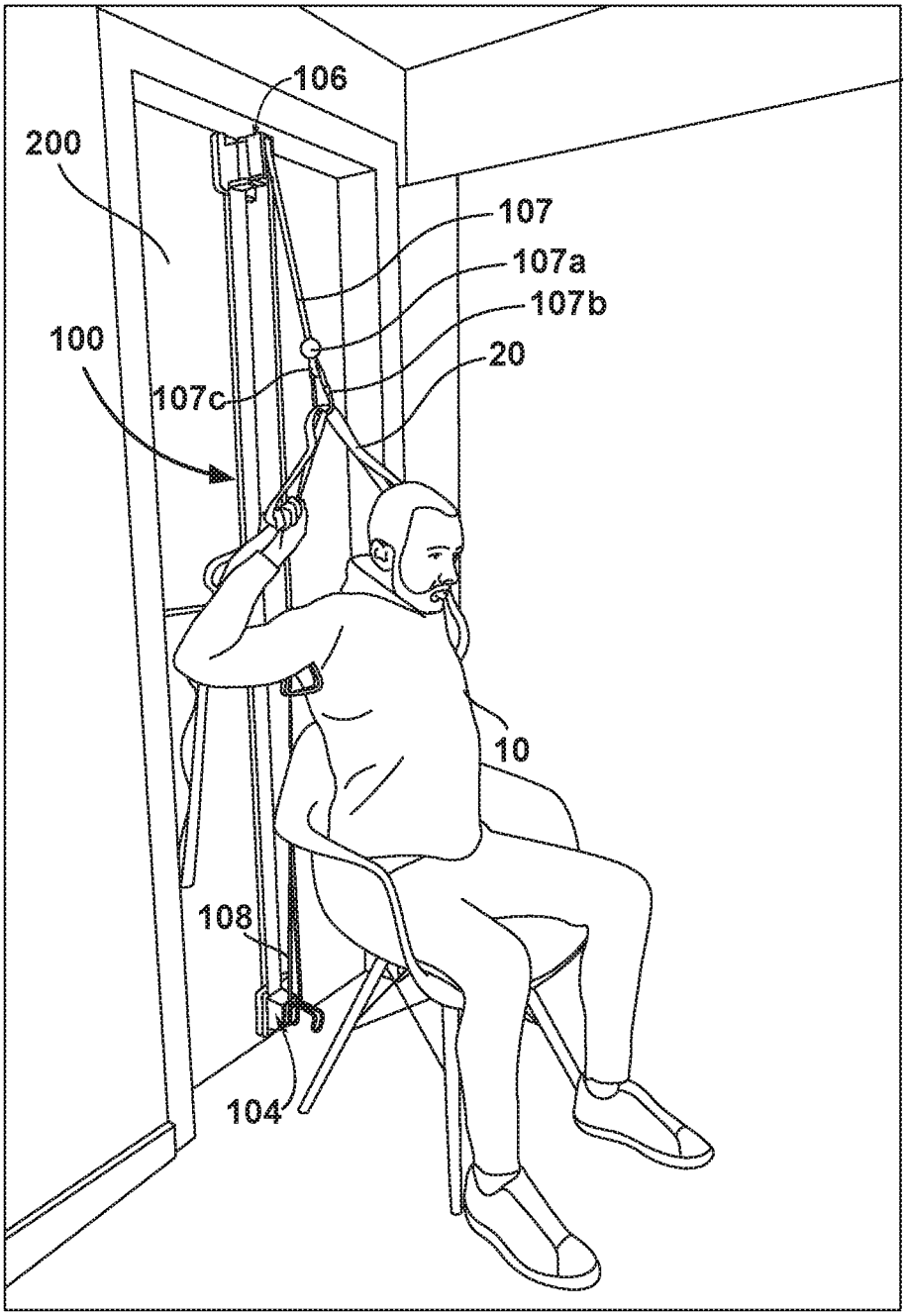

Referring to FIG. 11, just like in FIG. 9, the system setup 100 of FIG. 2 is shown being used by a user 10 for performing back exercise to strengthen the muscles of the back. In particular a bar or other exercising accessory such as the accessory 20 is attached to the fastener 107*b* of the strap 107, and then the accessory 20 is pulled towards his shoulders or back. This exercise can be regarded as part of an upper body strength workout.

Figure 12:
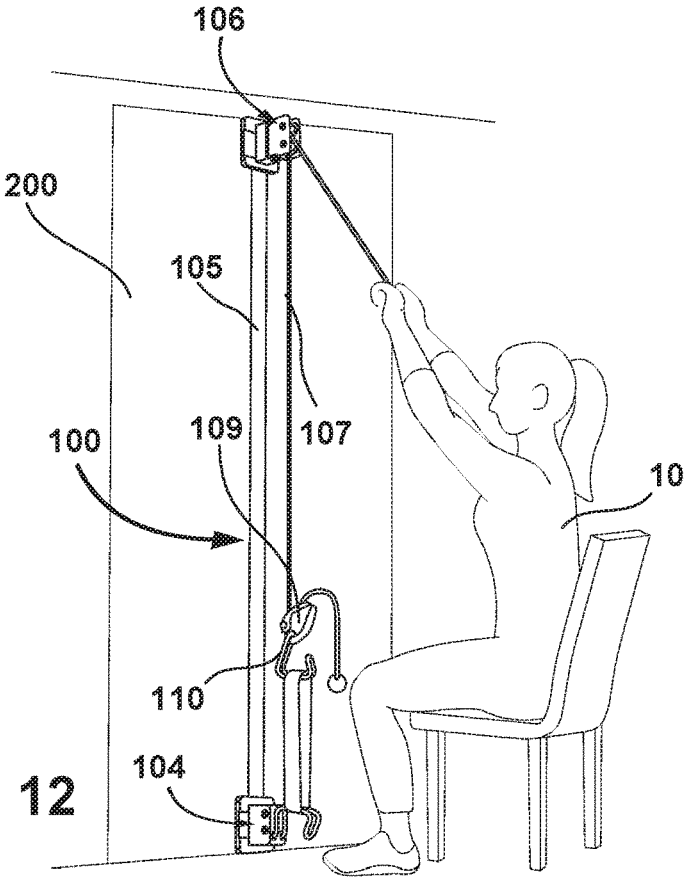

Similarly, FIG. 12 shows the system setup 100 of FIG. 2 being used by a user 10 for performing seated lat-pull down exercise. It is a type of back exercise. The pull down exercise works the back muscles, especially the latissimus dorsi. During this exercise, the user 10 usually seats and connects a bar or other exercising accessory (not seen) to the fastener 107*b* of the strap/rope 107 and then pulls the hanging bar or accessory down toward himself/herself, to reach chin level, and then release it back up. This exercise can be regarded as part of an upper body strength workout.

Figure 13:
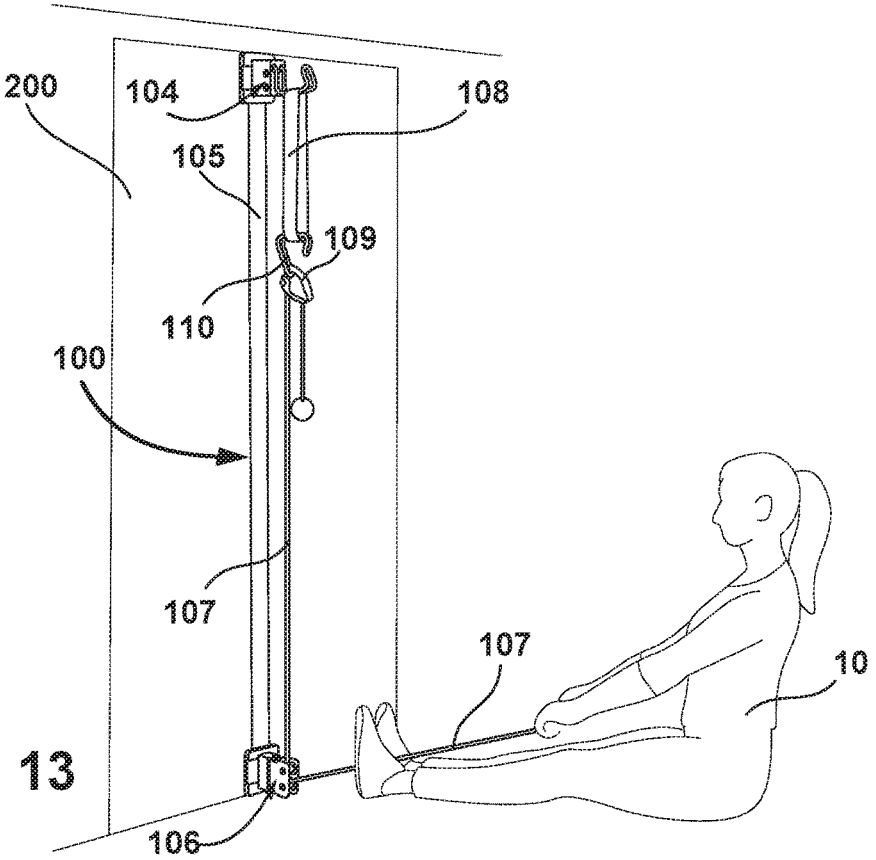

FIG. 13 shows the system setup 100 of FIG. 1A-1B in use by a user 10 for performing seated pulley row exercise. Seated pulley row is use to train the muscles of the upper back, biceps, and lats. Once the exercising system 100 is set up by the user 10 over the door 200 with appropriate workable resistance (that can again be adjusted by the user 10 as described above), the user 10 can use a rod or a suitable exercising accessory such as the accessory 20 and connect it to the fastener 107*b* of the strap/rope 107, and once the user 10 has adapted to a start position with appropriate workable resistance, the user 10 then can pull the strap/rope 107 towards ones abdomen, this rotates the pulleys 106*c* and allows the strap 107 to get pulled upward towards the user 10 stretching the band 108 (which can extend as much as resistance value of the band 108), if the user 10 just wishes to lose or add some small resistance value, the user 10 is enabled to do so by operating the securing device as well to loosen or tighten the rope 107.

Figure 14:
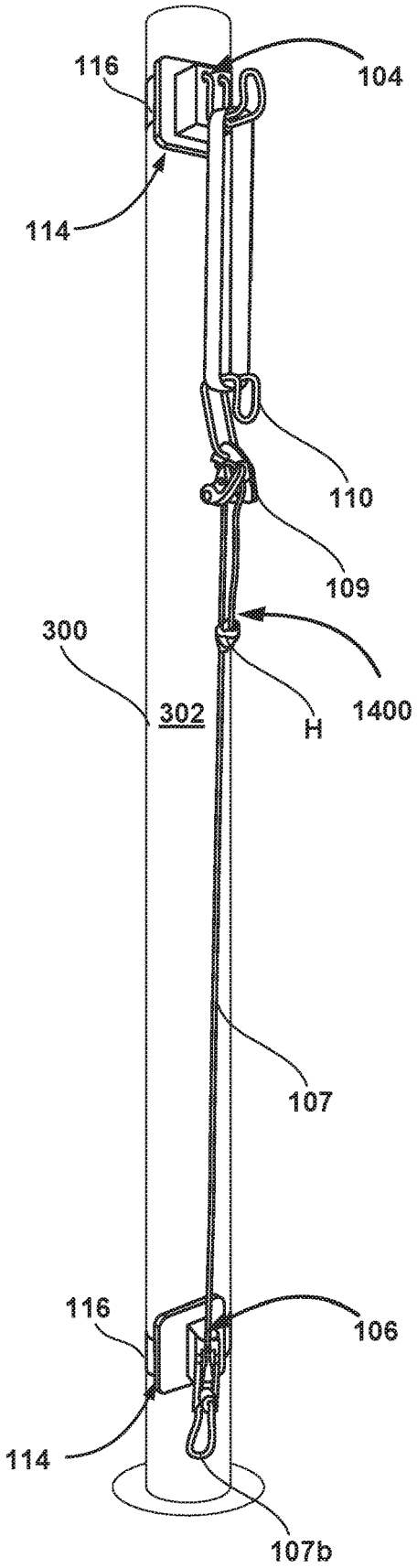
FIG. 14 shows a perspective view of a portable full body work out system of the present invention mounted over a vertical structure (Eg. vertical post), according to another embodiment.
Figure 15A:
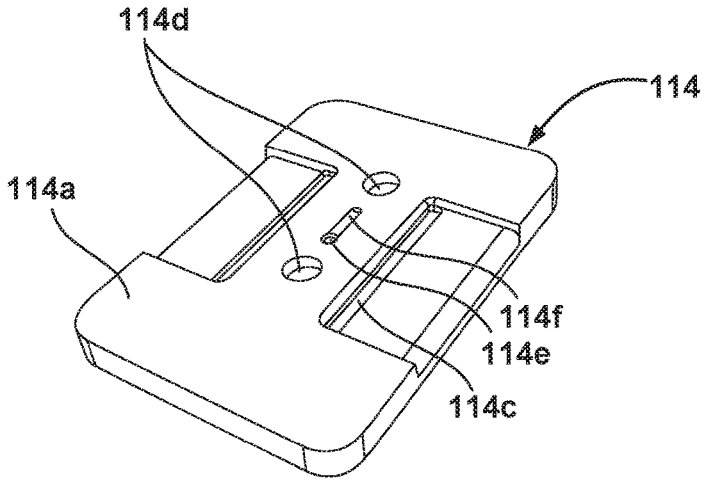
FIGS. 15A-15C shows a top perspective view, a bottom perspective view, and a side view of a plate member of a mount mountable onto the vertical post, according an embodiment of the present invention.
Figure 15B:
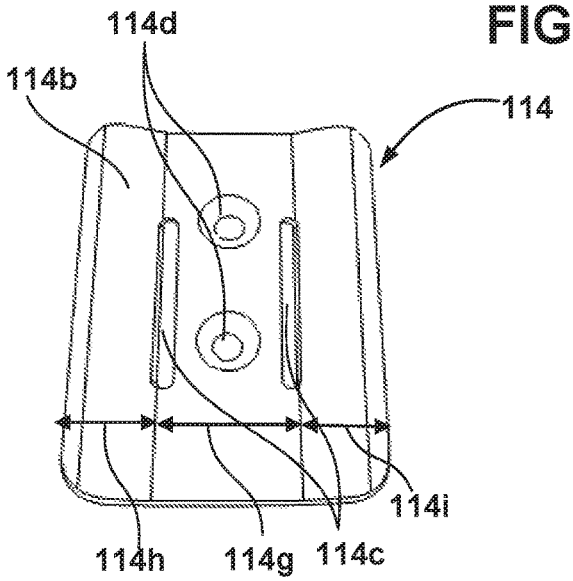
Figure 15C:
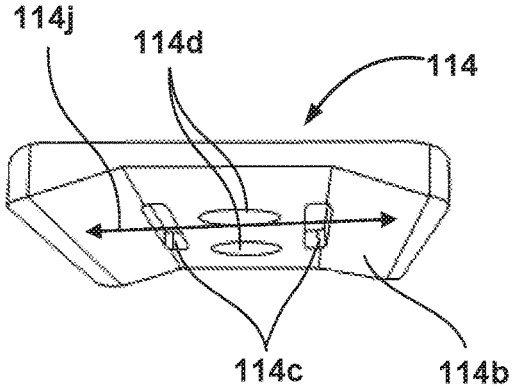
Figure 15D:
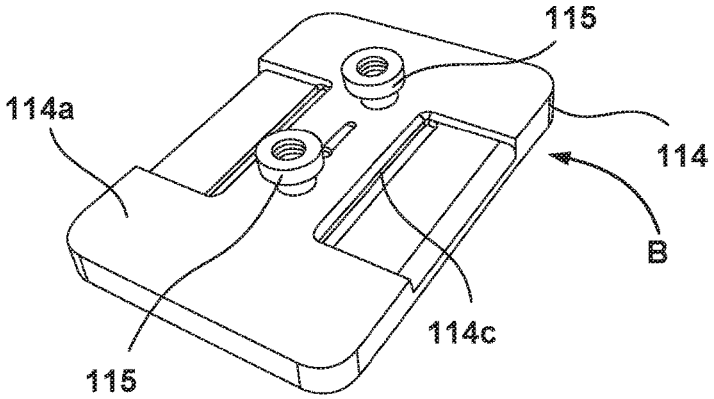
FIG. 15D shows a top perspective view of the mount mountable onto the vertical post, according an embodiment of the present invention.

Referring to FIGS. 14-17, the portable full body work out system 1400 and associated components configurable on a vertical structure 300 for strength training and performing a variety of resistance exercises are shown. The vertical structure 300 for the purpose of this invention includes but not limited to poles, columns, trees, lamp posts and so on. As seen in FIG. 14, the system 1400 essentially includes the components identical to the ones shown and described above with respect to FIGS. 1A-1B, and 2 except configuration of outdoor attachments or adapters such as mounts (referred to as 'B') being used for setting up the system 1400 over the vertical structure 300, and the way the mounts B are configured over the surface of the vertical structure 300.

As seen in FIGS. 15A-15D, the mount B (a first and/or second mount) used in the proposed work out system 1200 includes a plate member 114 having a top surface 114*a*, a bottom surface 114*b*. The plate member 114 includes a pair of vertically oriented elongated openings 114*c* each located in proximity to a left and right surface edge of the plate member 114. The plate member 114 further includes a pair of slots 114*d* located in between the vertically oriented elongated openings 114*c*, a bearing slot 114*e* located in between the slots 114*d*, a recessed channel 114*f* extending away from the bearing slot 114*e* and located over the top surface 114*a* of the plate member 114. In this embodiment of the invention, the mounts B are designed in such as way that the respective plate member 114 is non planar. In particular, the plate member 114 consists of a section 114*g*, a segment 114*h*, and a segment 114*i* conjoint together. The segment 114*h* and segment 114*i* structurally forms an inclination that connect to the section 114*g* so that a curve like space 114*j* is formed in between the segment 114*h*, and the segment 114*i* sufficient to surround the surface 302 of the vertical structure. Each of the mounts B further includes a pair of engagement members 115. The pair of engagement members 115 may rotatably engage to the slots 114*d* of the plate member 114.

Further, as seen in FIG. 14, the mounts B are configured over the structure 300 using a fastener system. The fastener system may include but not limited to a ratchet strap system or a tape such that may engage to, or pass through the pair of vertically oriented elongated openings 114*c* of each of the plate members 114 of the mounts B to fixedly attach the mounts B over the selected first and second location of the surface 302 of the vertical structure 300.

Figure 16:
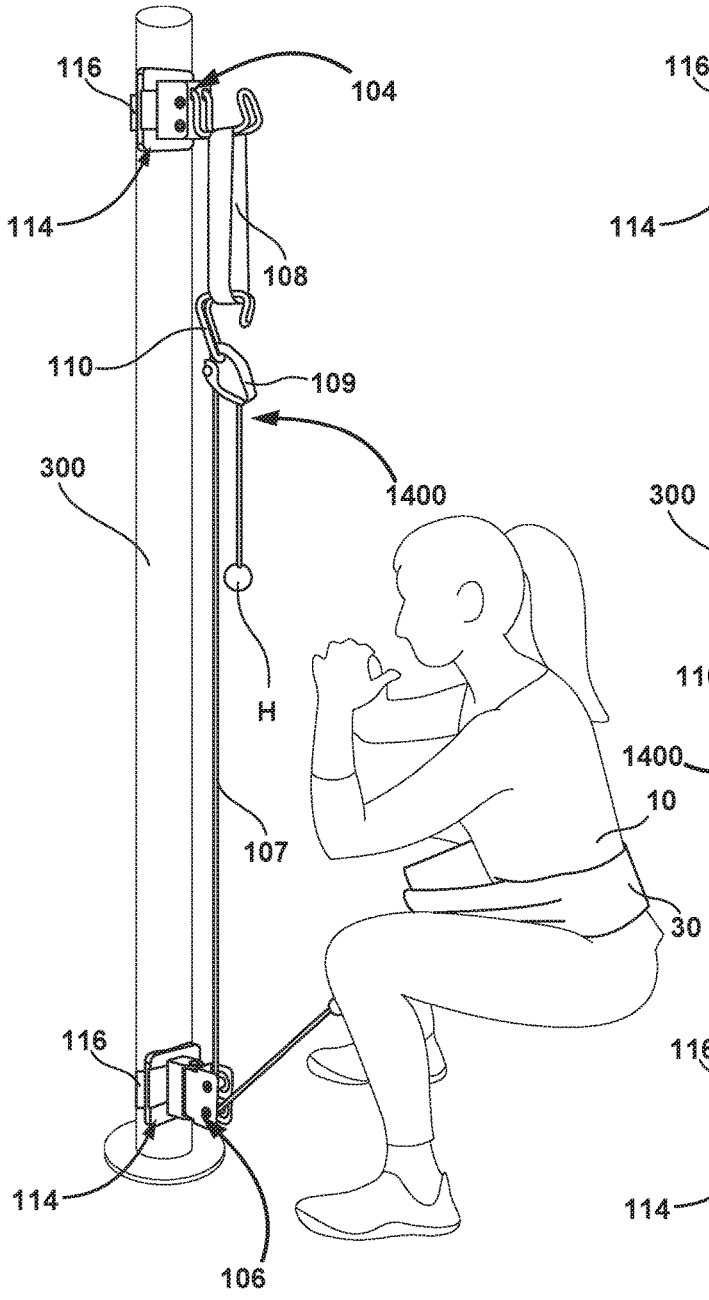
FIGS. 16-17 shows perspective views of the workout system of FIG. 14 in use by a user for performing squats.
Figure 17:
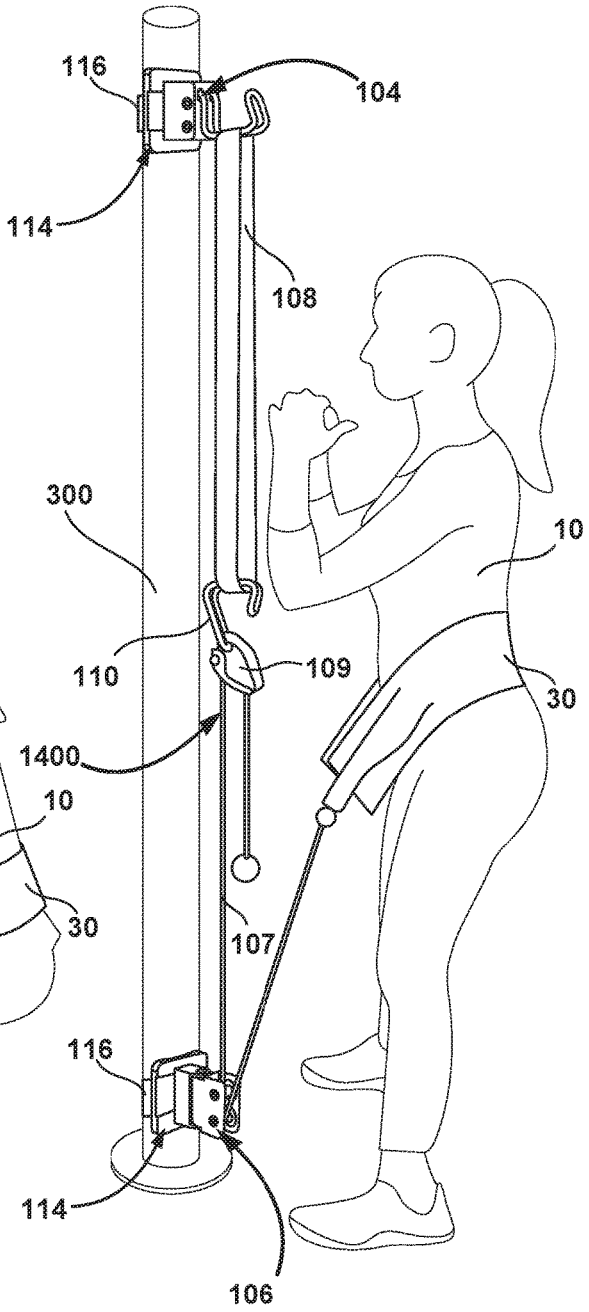

Referring to FIGS. 16-17 shows perspective views of the workout system of FIG. 14 in use by a user for performing squats. As explained above with respect to FIG. 10, while performing squats, the user 10 lowers his hip (as seen in FIG. 16) from a standing position (as seen in FIG. 17) and then stands back up. Proper squats strengthen the legs, glutes, and many other muscles, improve lower body mobility, and keep bones and joints healthy. With respect to FIGS. 16-17, once the exercising system 1400 is set up by the user 10 over the vertical structure (Eg. a post) 300 with appropriate workable resistance (that can again be adjusted by the user 10), the user 10 can use a suitable exercising accessory such as an accessory 30 (for example a waist or hip belt in this case) and connect it to the fastener 107*b* of the strap 107, and once the user 10 has adapted to a start position with appropriate workable resistance, the user 10 then can start and pull the strap/rope 107, this rotates the pulleys 106*c* and the first end of the strap 107 is pulled towards the user 10 stretching the band 108 (which can extend as much as resistance value of the band 108), if the user 10 wishes to lose or add some small resistance value, the user 10 can do so by operating the securing device 109 and loosen or tighten the rope 107 slightly.

Figure 18:
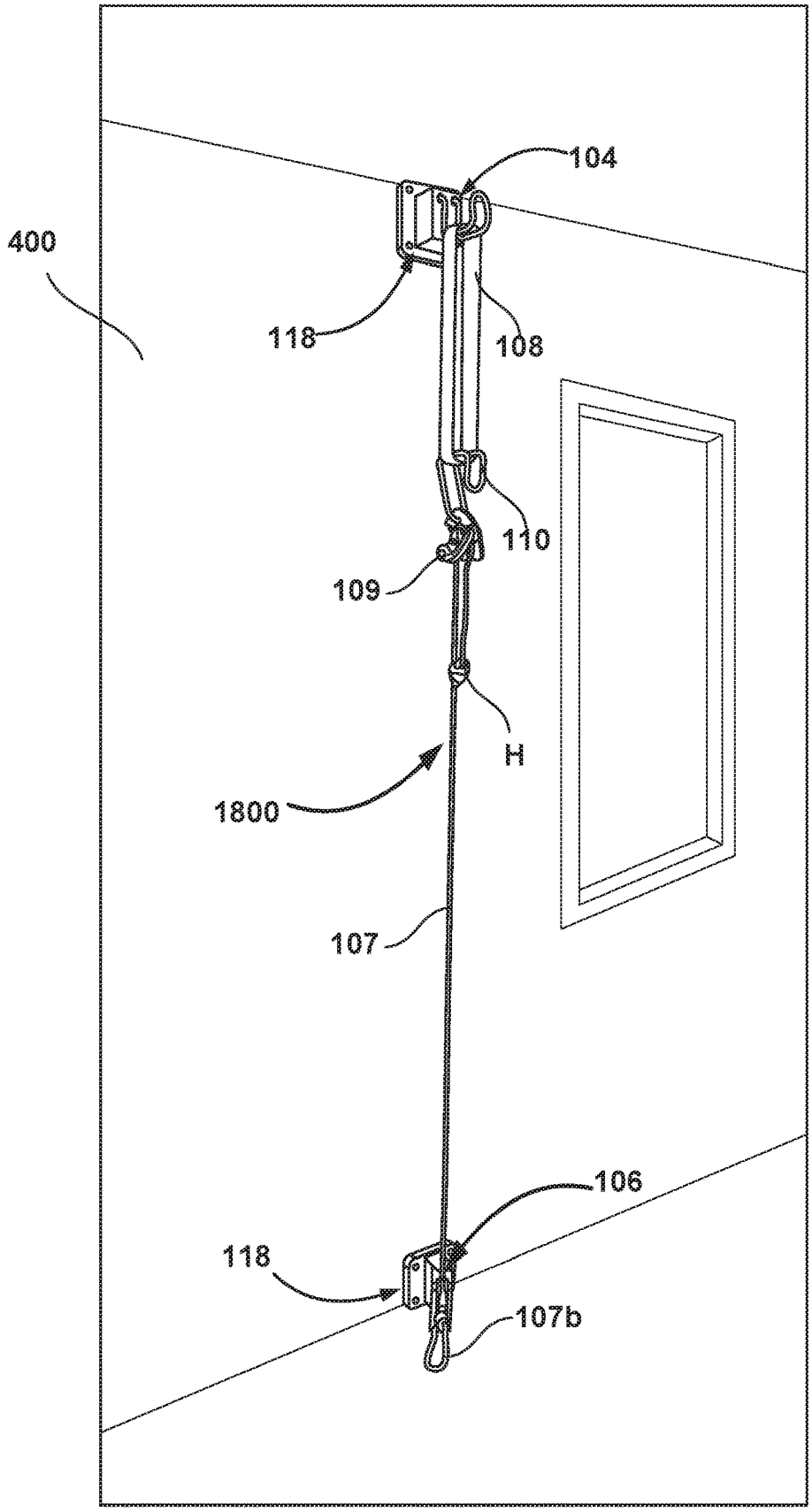
FIG. 18 shows a perspective view of a portable full body workout system of the present invention mounted over a wall, according to yet another embodiment.

Referring to FIGS. 18-21, the portable full body work out system 1800 and associated components configurable on a wall 400 for strength training and performing a variety of resistance exercises are shown. The wall 400 for the purpose of this invention may include any planar surface made of concrete material or wooden material and so on. As seen in FIG. 18, the system 1800 essentially includes the components identical to the ones shown and described above with respect to FIGS. 1A-1B, and 2 or FIG. 14 except configuration of wall attachments or adapters such as mounts (referred to as 'C') being used for setting up the system 1800 over the wall 400, and the way the mounts C are configured over the surface of the wall 400.

Figure 19A:
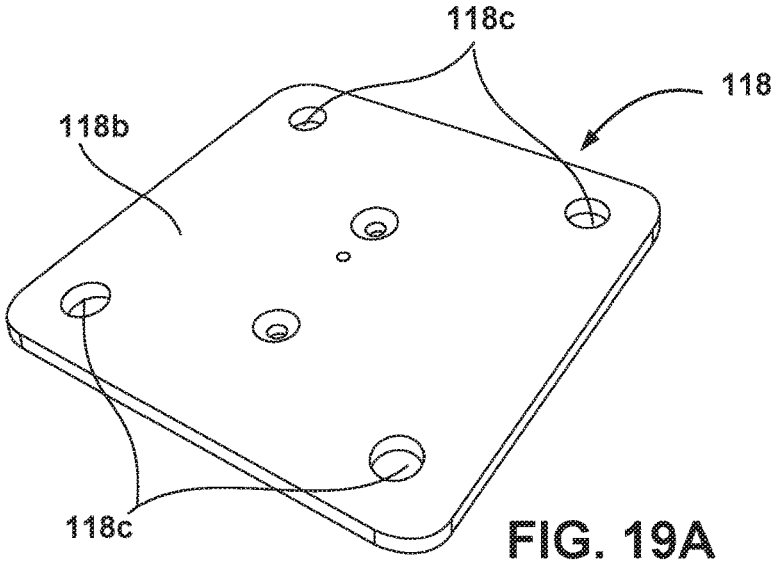
FIGS. 19A-19B shows a top perspective view, and a bottom perspective view of a plate member of a mount mountable over the wall, according an embodiment of the present invention.
Figure 19B:
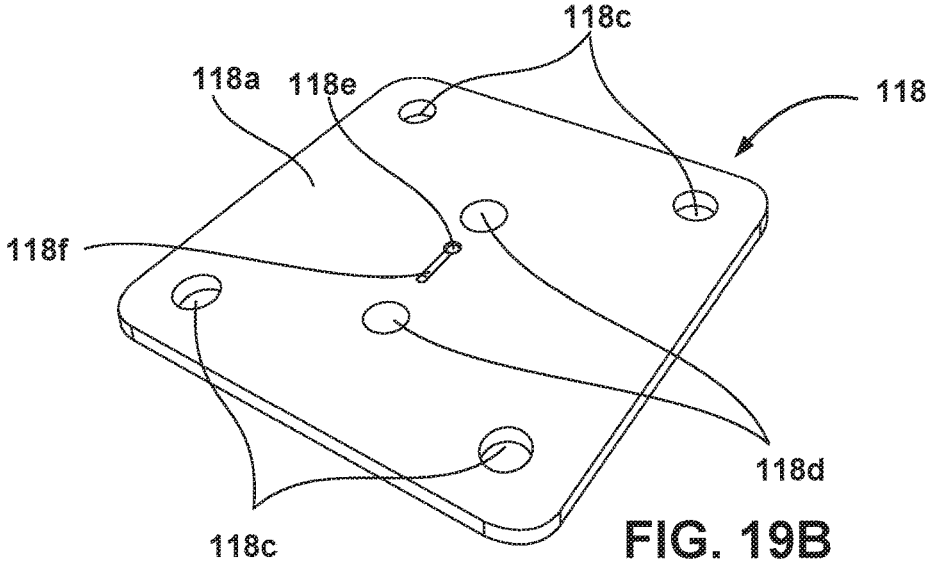
Figure 19C:
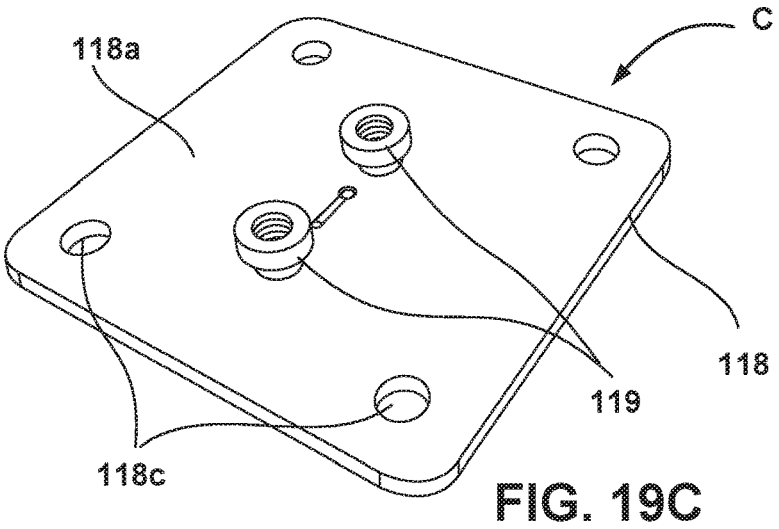
FIG. 19C shows a top perspective view of the mount mountable over the wall, according an embodiment of the present invention.

As seen in FIGS. 19A-19C, the mount C (a first and/or second mount) used in the proposed work out system 1800 (according to another embodiment) includes a plate member 118 having a top surface 118*a*, a bottom surface 118*b*, a pair of slots 118*d* located substantially around the center of the top surface 118*a*, a bearing slot 118*e* located in between the pair of slots 118*d*, and a recessed channel 118*f* extending away from the bearing slot 118*e*. The plate member 118 further includes slots 118*c* configured for mounting the plate member 118 over the wall 400. In an example, the there are four slots 118*c* each located at a corner of the plate member 118. Each of the mount C further includes a pair of engagement members 119. Each of the engagement members 119 rotatably engages to the slots 118*d*. The mounts C are configured over the first and second location of the surface of the wall using one or more fasteners (such as screws, nails and so on). The fasteners engage to the slots 118*c* for fixedly attaching the mounts C over the first and second location of the surface of the wall 400.

Figure 20:
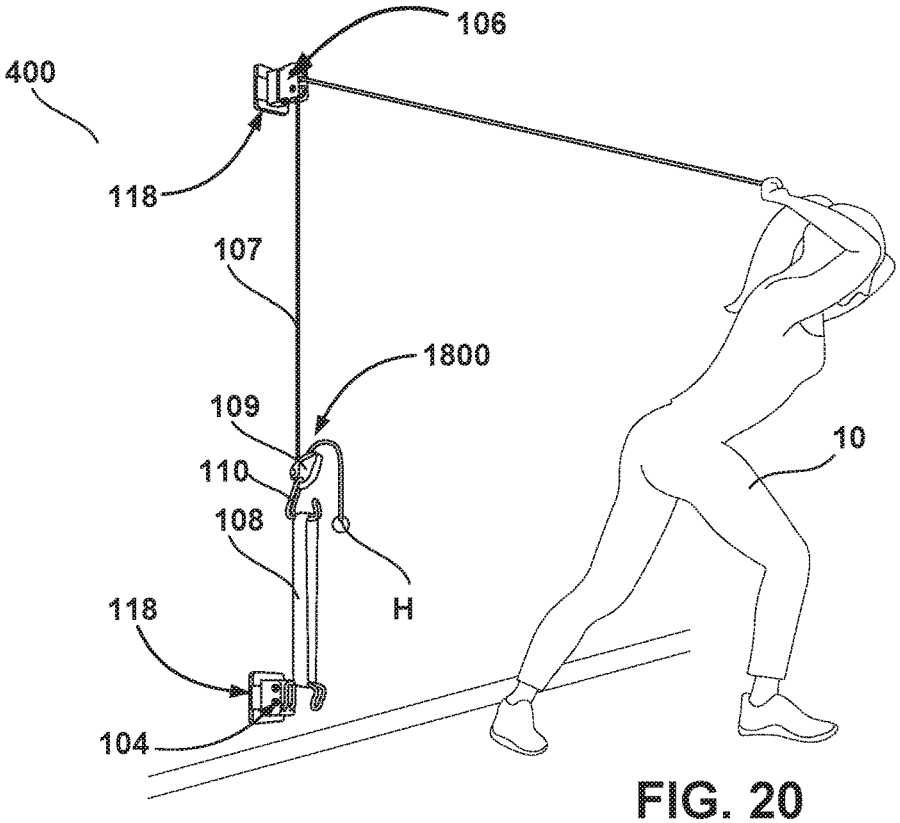
FIGS. 20-21 shows perspective views of the workout system of FIG. 18 in use by a user for performing overhead triceps extensions, and hip abduction, respectively.

Referring to FIG. 20 shows perspective view of the workout system of FIG. 18 in use by a user 10 for performing overhead triceps extension (a type of triceps exercise). As seen, the positions of the bracket assemblies 104, and 106 are swapped or interchanged in order to perform this exercise. This exercise targets to strengthen the muscles present in the back of the upper arm, where triceps brachii muscles are located. Once the system 1800 is setup on the wall 400 with desired exercise resistance (that can obviously be adjusted as discussed above by adding or removing the resistance values or the resistance bands 108), the user 10 can grab and hold the fastener 107*b* (present at first end of the strap extension 107) or first end of the rope extension 107 with both hands and palms facing up and then raise the rope/strap 107 over the head. Then the user 10 will slowly lower the fastener 107*b* or the end of the strap 107 in an arc motion behind the head, feeling a stretch and isolating the tricep muscles and then hold the position for a short period of time, before repeating the same again. The user 10 if needed can also connect some external exercising accessory such as a bar (not seen) to the fastener 107*b* to perform this exercise. When the user 10 pulls the strap/rope 107, it rotates the pulleys 106*c* and the first end of the strap 107 is pulled towards the user 10 stretching the band 108 (which can extend as much as resistance value of the band 108), if the user 10 wishes to lose or add some small resistance value, the user 10 can do so by operating the securing device 109 and loosen or tighten the rope 107 slightly.

Figure 21:
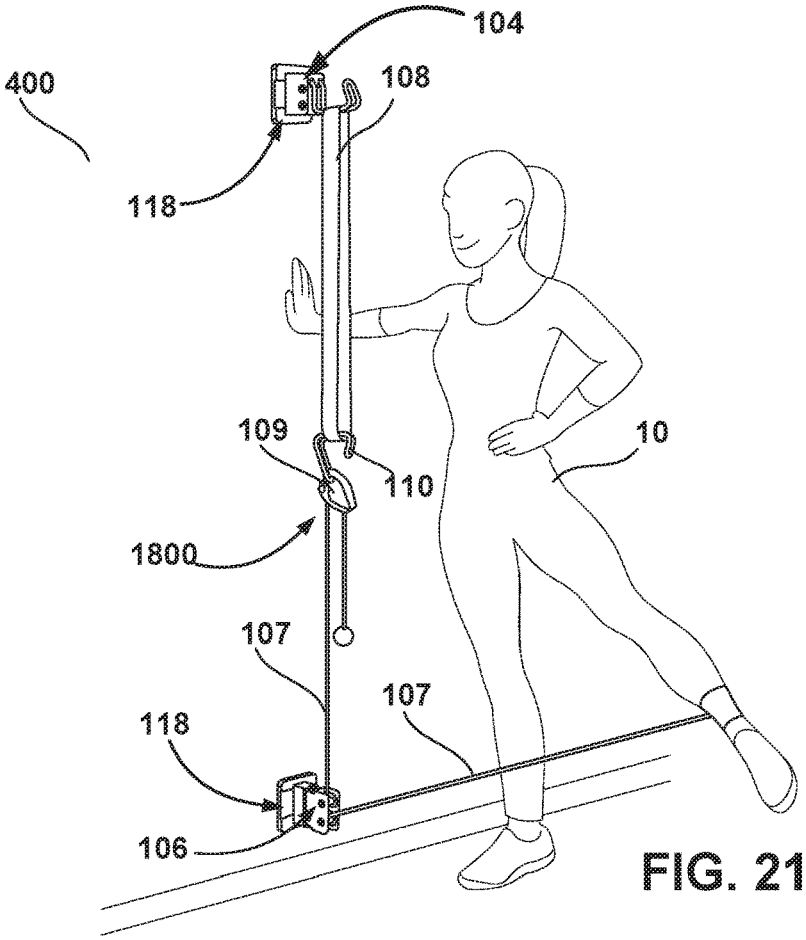

Referring to FIG. 21 that shows a perspective view of the workout system of FIG. 18 in use by a user 10 for performing hip abduction exercise particularly standing hip abduction. The system 1800 is setup similar to FIG. 18. This exercise particularly targets hip adductors and abs. Once the system 1800 is setup with appropriate desired resistance or tension, the user 10 may use a band (not seen) or similar exercising accessory placed around the user's ankle to connect to the extending strap 107 (via fastener 107*b*). The user 10 then can kick the leg out to the side of his/her body slowly to pull the strap/rope 107. The rope 107 gets pulled due to rotation of the one or more pulleys 106*c*. The pull of strap/rope 107 stretches the band 108 (which can extend as much as resistance value of the band 108), if the user 10 wishes to lose or add some small resistance value, the user 10 can do so by operating the securing device 109 to loosen or tighten the rope 107 slightly.

Further according to some other embodiment, the present invention may be practiced without the securing device 109, instead the second end of the strap/rope 107 may be passed over the carabiner or other fastener devices such as hook and loop fastener etc. or be directly connected to the retainer device 110. Such configuration can help the user with exercising with even very low level of resistances (<1 kg), as mostly the securing device 109 starts to work to block the sliding rope (passing therethrough) approx around 1 kg weight or in some cases around 2 kgs weight.

The proposed exercise device or system 100, or 1400 or 1800 and associated components thereof such as bracket assemblies 104, 106, mounts A, or B or C, strap/rope 107, resistance bands 108 and so on may be made of various suitable materials in variety of sizes, for example the bracket assemblies, the plate members of the mounts may be made of metal, and likewise other components such as strap/rope 107 or strap 105 of the fastener system may be made of variety of materials. Various substitute components may be used for example for the securing device 109, retainer members 104*a*, 110, tensioner device 112 of the fastener system, and so on. and One should understand, such changes or use of substitute components should be considered to be within the realm of the presented invention.

Further, in the embodiments described above, the coupling/attachment of the bracket assemblies to the mounts is facilitated by mounting slots of the bracket assemblies and the corresponding engagement members of the mounts and is further facilitated by rollable lock/bearing lock of the bracket assemblies and corresponding bearing slot and recessed channel present in the plate members of the mounts. However, one skilled in the art should understand, there can be several other techniques to attach the brackets to the mounts, such as one can use some magnetic mechanisms between the mounts and the bracket assemblies or any other suitable mechanisms that may replace the presence and function of bearing slot and the recessed channel, and thus variations should be considered within the realm or scope of the presented disclosure. In the above embodiments, the technique to attach the bracket assemblies onto the mounts are described to be automatic in nature, however, it is possible to devise an attachment mechanism that may be semi-automatic in nature. For an example, one can slidably push or press (or press and push) to attach the bracket assemblies onto the mount and one can then press some release button to be able to release the connection between the bracket assemblies and the mounts.

Although particular embodiments of the invention have been described in detail for purposes of illustration, various modifications and enhancements may be made without departing from the spirit and scope of the invention.

What is claimed is:

1. A portable full body workout system, comprising:

a first mount configurable over a first location of a surface, and a second mount configurable over a second location of the surface, wherein the first and second mounts are vertically in-line with each other along the surface;

a first bracket assembly releasably mountable to the first mount;

a second bracket assembly releasably mountable to the second mount;

a longitudinally extending strap having a first end and a second end, the first end comprising a first fastener attached thereto, and the second end of the strap extending around the second bracket assembly and securely connecting to a securing device capable of selectively allowing a user to pull the strap passing therethrough;

at least one resistance band having a predetermined resistance releasably attached around, and extending between the first bracket assembly and the securing device;

wherein, the securing device is configured to allow the strap to be selectively pulled so that the user can adapt to an appropriate position to connect an external exercising accessory to the first fastener of the strap for performing an exercise; and wherein, the at least one resistance band, and the strap are configured to allow the user to select the resistance desired for the exercise, or reduce the resistance, or combine resistances for even greater resistance.

2. The system of claim 1, wherein the first location and the second location are spaced apart and vertically aligned with each other over the surface.

3. The system of claim 1, wherein the first and second mount each comprises:

a plate member having a top surface, a bottom surface, a pair of horizontally oriented elongated openings each located in proximity to a top and bottom surface edges of the plate member, a pair of slots located in between the horizontally oriented elongated openings, a bearing slot located in between the pair of slots, a recessed channel extending away from the bearing slot and located over the top surface of the plate member;

a pair of engagement members, wherein each of the pair of engagement members rotatably engages to the slots; and a cover for receiving the plate member therein.

4. The system of claim 3, wherein, the first bracket assembly including a body portion having a first pair of mountable slots and a first rollable lock located in between the first pair of mountable slots, and a first retainer member coupled to the body portion, the second bracket assembly including a first portion having a second pair of mountable slots and a second rollable lock located in between the second pair of mountable slots, and a second portion housing one or more rotatable pulleys and swingably coupled to the first portion, and the pair of engagement members of the first and second mount engagingly receives the first pair of mountable slots of the first bracket assembly and the second pair of mountable slots of the second bracket assembly respectively to facilitate releasable connection between the first mount and the first bracket assembly, and the second mount and the second bracket assembly respectively.

5. The system of claim 4, wherein the bearing slot of the first and second mount rollably receives the first rollable lock of the first bracket assembly, and the second rollable lock of the second bracket assembly respectively to further facilitate releasable connection between the first mount and the first bracket assembly, and the second mount and the second bracket assembly respectively.

6. The system of claim 5, wherein the first rollable lock and the second rollable lock of the first bracket assembly and second bracket assembly respectively slide along the recessed channel to releasably engage to the bearing slot of the first and second mount respectively.

7. The system of claim 1, wherein the first and second mount each comprises:

a plate member having a top surface, a bottom surface, a pair of vertically oriented elongated openings each located in proximity to a left and right surface edges of the plate member, a pair of slots located in between the vertically oriented elongated openings, a bearing slot located in between the slots, a recessed channel extending away from the bearing slot and located over the top surface of the plate member the plate member consists of a first section, a second segment, and a third segment conjoint together, wherein the second segment, and third segment are structurally inclined to connect to the first section so that a curve like space is formed in between the second segment, and the third segment sufficient to surround the surface of the vertical structure; and a pair of engagement members, wherein each of the pair of engagement members rotatably engages to the slots.

8. The system of claim 1, wherein the first and second mount each comprises:

a plate member having a top surface, a bottom surface, a pair of slots located substantially around the center of the top surface, a bearing slot located in between the pair of slots, a recessed channel extending away from the bearing slot, wherein the plate member further comprising a plurality of slots configured for mounting the plate member over the wall; and a pair of engagement members, wherein each of the pair of engagement members rotatably engages to the slots.

9. The system of claim 1, wherein the longitudinally extending strap comprising at least a rope, or a cable.

10. The system of claim 1, wherein the first fastener is a carabiner.

11. The system of claim 1, wherein the first mount and second mount are identical or non-identical in shape and dimensions.

12. The system of claim 1, wherein the first end of the longitudinally extending strap further comprises a stopper and a loop formed next to the stopper and includes the first fastener connected thereto.

13. The system of claim 3, wherein the first mount and second mount are configured over the first location and second location of the surface of a door using a first fastener system, wherein a strap of the first fastener system engages to, or passes through the pair of horizontally oriented elongated openings of each of the plate members of the first mount and second mount respectively to fixedly mount the first mount and second mount over the first and second location of the surface of the door.

14. The system of claim 13, wherein the strap is selectively tightened using a tensioner device of the first fastener system to set up the system over the door.

15. The system of claim 7, wherein the first mount and second mount are configured over the first location and second location of the surface of a vertical structure using a second fastener system, wherein a strap or tape of the second fastener system engages to, or passes through the pair of vertically oriented elongated openings of each of the plate members of the first mount and second mount respectively to fixedly mount the first mount and second mount over the first and second location of the surface of the vertical structure.

16. The system of claim 8, wherein the first mount and second mount are configured over the first location and second location of the surface of a wall using one or more fasteners, wherein the one or more fasteners engages to the plurality of slots for fixedly mounting the first mount and second mount over the first and second location of the surface of the wall.

17. The system of claim 1, wherein a first retainer member of the first bracket assembly and a second retainer member coupled to the securing device are substantially U-shaped.

18. The system of claim 1, wherein the securing device comprises a belay device.

* * * * *